US011105018B2

(12) United States Patent
Zillig et al.

(10) Patent No.: US 11,105,018 B2
(45) Date of Patent: Aug. 31, 2021

(54) DIMENSIONALLY-STABLE MELT BLOWN NONWOVEN FIBROUS STRUCTURES, AND METHODS AND APPARATUS FOR MAKING SAME

(71) Applicant: 3M INNOVATIVE PROPERTIES COMPANY, St. Paul, MN (US)

(72) Inventors: Daniel J. Zillig, Woodbury, MN (US); Sachin Talwar, Woodbury, MN (US); Randy L. Christiansen, Woodbury, MN (US); Michael D. Romano, Circle Pines, MN (US); Eric M. Moore, Roseville, MN (US); Pamela A. Percha, Woodbury, MN (US); Liming Song, Woodbury, MN (US); Myles L. Brostrom, West Lakeland Township, MN (US); Michael D. Swan, Lake Elmo, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 152 days.

(21) Appl. No.: 16/514,608

(22) Filed: Jul. 17, 2019

(65) Prior Publication Data

US 2019/0338447 A1 Nov. 7, 2019

Related U.S. Application Data

(62) Division of application No. 15/038,487, filed as application No. PCT/US2014/066325 on Nov. 19, 2014, now Pat. No. 10,400,354.

(Continued)

(51) Int. Cl.

*D01D 5/098* (2006.01)
*D04H 1/56* (2006.01)

(Continued)

(52) U.S. Cl.

CPC ..... *D01D 5/0985* (2013.01); *D01D 5/084* (2013.01); *D01D 5/088* (2013.01); *D04H 1/55* (2013.01);

(Continued)

(58) Field of Classification Search

CPC ..... D04H 1/55; D04H 1/56; D04H 1/565; D01D 5/0985; D01D 5/084; D01D 5/088;

(Continued)

(56) References Cited

U.S. PATENT DOCUMENTS 3,516,941 A 6/1970 Matson
3,971,373 A 7/1976 Braun (Continued)

FOREIGN PATENT DOCUMENTS

EP 0218473 4/1987
EP 0218473 A2 4/1987

(Continued)

OTHER PUBLICATIONS

Binsbergen, "Natural and Artificial Heterogeneous Nucleation in Polymer Crystallization", Journal of Polymer Science: Polymer Symposium, 1977, vol. 59, No. 1, pp. 11-29.

(Continued)

*Primary Examiner* — Jeremy R Pierce
(74) *Attorney, Agent, or Firm* — James A. Baker

(57) ABSTRACT

A process and apparatus for producing a dimensionally stable melt blown nonwoven fibrous web. The process includes forming a multiplicity of melt blown fibers by passing a molten stream including molecules of at least one thermoplastic semi-crystalline (co)polymer through at least one orifice of a melt-blowing die, subjecting at least a portion of the melt blown fibers to a controlled in-flight heat treatment operation at a temperature below a melting temperature of the at least one thermoplastic semi-crystalline (Continued)

(co)polymer immediately upon exiting from the at least one orifice, and collecting at least some of the melt blown fibers subjected to the controlled in-flight heat treatment operation on a collector to form a non-woven fibrous structure. The nonwoven fibrous structure exhibits a Shrinkage less than a Shrinkage measured on an identically-prepared structure including only fibers not subjected to the controlled in-flight heat treatment operation, and generally less than 15%.

13 Claims, 6 Drawing Sheets

Related U.S. Application Data

(60) Provisional application No. 61/909,175, filed on Nov. 26, 2013, provisional application No. 62/018,700, filed on Jun. 30, 2014, provisional application No. 62/064,243, filed on Oct. 15, 2014.

(51) Int. Cl.
*D04H 1/55* (2012.01)
*D01D 5/084* (2006.01)
*D01D 5/088* (2006.01)

(52) U.S. Cl.
CPC ..... *D04H 1/56* (2013.01); *D04H 1/565* (2013.01); *D10B 2321/022* (2013.01); *D10B 2331/04* (2013.01); *D10B 2331/041* (2013.01)

(58) Field of Classification Search
CPC ..... D10B 2331/041; D10B 2331/04; D10B 2321/022
See application file for complete search history.

(56) References Cited

U.S. PATENT DOCUMENTS

| | | | |
|---|---|---|---|
| 4,100,324 | A | 7/1978 | Anderson |
| 4,118,531 | A | 10/1978 | Hauser |
| 4,215,682 | A | 8/1980 | Kubik |
| 4,798,850 | A | 1/1989 | Brown |
| 4,813,948 | A | 3/1989 | Insley |
| 4,818,464 | A | 4/1989 | Lau |
| 5,332,426 | A | 7/1994 | Tang |
| 5,364,694 | A | 11/1994 | Okada |
| 5,401,446 | A | 3/1995 | Tsai |
| 5,496,507 | A | 3/1996 | Angadjivand |
| 5,641,555 | A | 6/1997 | Berrigan |
| 5,643,507 | A | 7/1997 | Berrigan |
| 5,658,640 | A | 8/1997 | Berrigan |
| 5,658,641 | A | 8/1997 | Berrigan |
| 5,753,736 | A | 5/1998 | Bhat |
| 5,908,598 | A | 6/1999 | Rousseau |
| 6,119,691 | A | 9/2000 | Angadjivand |
| 6,371,749 | B2 | 4/2002 | Thompson |
| 6,375,886 | B1 | 4/2002 | Angadjivand |
| 6,397,458 | B1 | 6/2002 | Jones |
| 6,406,657 | B1 | 6/2002 | Eitzman |
| 6,420,024 | B1 | 7/2002 | Perez |
| 6,454,986 | B1 | 9/2002 | Eitzman |
| 6,607,624 | B2 | 8/2003 | Berrigan |
| 6,613,268 | B2 | 9/2003 | Hynes et al. |
| 6,645,618 | B2 | 11/2003 | Hobbs |
| 6,740,137 | B2 | 5/2004 | Kubokawa |
| 6,743,464 | B1 | 6/2004 | Insley |
| 6,849,329 | B2 | 2/2005 | Perez |
| 7,780,903 | B2 | 8/2010 | Topolkarave |
| 2003/0160861 | A1 | 8/2003 | Barlow |
| 2008/0160861 | A1* | 7/2008 | Berrigan ..... D04H 1/55 442/400 |
| 2011/0151737 | A1 | 6/2011 | Moore |
| 2012/0088424 | A1* | 4/2012 | Moore ..... D04H 1/55 442/400 |
| 2013/0288556 | A1 | 10/2013 | Moore et al. |

FOREIGN PATENT DOCUMENTS

| | | | | |
|---|---|---|---|---|
| EP | 0527489 | A1 * | 2/1993 | ..... D04H 1/56 |
| JP | 1995(H07)-011556 | A | 1/1995 | |
| JP | H07138860 | | 5/1995 | |
| WO | WO 2011-106205 | | 9/2011 | |

OTHER PUBLICATIONS

Klug, X-Ray Diffraction Procedures for Polycrystalline and Amorphous Materials, 491-538 (1954).
Scherrer, Göttinger Nachrichten, 1918, pp. 98-100.
Wente, "Manufacture of Superfine Organic Fibers", Naval Research Laboratories Report No. 4364, May, 1954, 21 pgs.
Wente, "Superfine Thermoplastic Fibers", Industrial Engineering Chemistry, Naval Research Laboratory, Aug. 1956, vol. 48, No. 8, pp. 1342-1346.
International Search Report for PCT International Application No. PCT/US2014/066325, dated Mar. 2, 2015, 4 pages.

* cited by examiner

DIMENSIONALLY-STABLE MELT BLOWN NONWOVEN FIBROUS STRUCTURES, AND METHODS AND APPARATUS FOR MAKING SAME

CROSS REFERENCE TO RELATED APPLICATIONS

This application is a divisional of U.S. application Ser. No. 15/038,487, filed May 23, 2016, now issued as U.S. Pat. No. 10,400,354, which is a US 371 Application based on PCT/US2014/066325, filed Nov. 19, 2014, which claims the benefit of U.S. Application No. 61/909,175, filed Nov. 26, 2013; U.S. Application No. 62/018,700, filed Jun. 30, 2014; and U.S. Application No. 62/064,243, filed Oct. 15, 2014, the disclosures of which are incorporated by reference in their entirety herein.

FIELD

The present disclosure relates to nonwoven fibrous structures including melt blown fibers, and more particularly, to dimensionally-stable melt blown nonwoven fibrous webs and methods and apparatus for preparing such webs.

BACKGROUND

Melt blowing is a process for forming nonwoven fibrous webs of thermoplastic (co)polymeric fibers. In a typical melt-blowing process, one or more thermoplastic (co)polymer streams are extruded through a die containing closely arranged orifices and attenuated by convergent streams of high-velocity hot air to form micro-fibers which are collected to form a melt blown nonwoven fibrous web.

Thermoplastic (co)polymers commonly used in forming conventional melt blown nonwoven fibrous webs include polyethylene (PE) and polypropylene (PP). Melt-blown nonwoven fibrous webs are used in a variety of applications, including acoustic and thermal insulation, filtration media, surgical drapes, and wipes, among others.

SUMMARY

One limitation of conventional melt blown nonwoven fibrous webs is a tendency to shrink when heated to even moderate temperatures in subsequent processing or use, for example, use as a thermal insulation material. Such shrinkage may be particularly problematic when the melt blown fibers include a thermoplastic polyester (co)polymer; for example poly(ethylene) terephthalate, poly(lactic acid), poly (ethylene) naphthalate, or combinations thereof; which may be desirable in certain applications to achieve higher temperature performance. Accordingly, it would be desirable to develop a melt-blowing process for producing a dimensionally stable melt blown nonwoven fibrous structure, and more particularly, a dimensionally stable melt blown nonwoven fibrous web including one or more polyester (co)polymers.

Thus, in one aspect, the present disclosure describes a process or method for producing a dimensionally stable melt blown nonwoven fibrous web. In some exemplary embodiments, the process includes forming a multiplicity of melt blown fibers by passing a molten stream including molecules of at least one thermoplastic semi-crystalline (co) polymer through a multiplicity of orifices of a melt-blowing die, subjecting at least a portion of the melt blown fibers to a controlled in-flight heat treatment operation immediately upon exit of the melt blown fibers from the multiplicity of orifices, wherein the controlled in-flight heat treatment operation takes place at a temperature below a melting temperature of the portion of the melt blown fibers for a time sufficient to achieve stress relaxation of at least a portion of the molecules within the portion of the fibers subjected to the controlled in-flight heat treatment operation, and collecting at least some of the portion of the melt blown fibers subjected to the controlled in-flight heat treatment operation on a collector to form a non-woven fibrous structure. The nonwoven fibrous structure exhibits a Shrinkage (as determined using the methodology described herein) less than a Shrinkage measured on an identically-prepared structure that is not subjected to the controlled in-flight heat treatment operation.

In other exemplary embodiments, the process includes providing to a melt-blowing die a molten stream of a thermoplastic material including at least one thermoplastic semi-crystalline (co)polymer wherein the thermoplastic material does not contain a nucleating agent in an amount effective to achieve nucleation, melt-blowing the thermoplastic material into at least one fiber, and subjecting the at least one fiber immediately upon exiting the melt-blowing die and prior to collection as a nonwoven fibrous structure on a collector, to a controlled in-flight heat treatment operation at a temperature below a melting temperature of the at least one thermoplastic semi-crystalline (co)polymer for a time sufficient for the nonwoven fibrous structure to exhibit a Shrinkage (when tested using the methodology described herein) less than a Shrinkage measured on an identically-prepared structure that is not subjected to the controlled in-flight heat treatment operation.

In another aspect, the present disclosure describes a nonwoven fibrous structure including a multiplicity of melt blown fibers containing molecules of at least one thermoplastic semi-crystalline (co)polymer, wherein the thermoplastic material does not contain a nucleating agent in an amount effective to achieve nucleation, and further wherein the nonwoven fibrous structure is dimensionally stable and exhibits a Shrinkage less than 15%.

In yet another aspect, the present disclosure describes an apparatus including a melt-blowing die, a means for controlled in-flight heat treatment of melt-blown fibers emitted from the melt-blowing die at a temperature below a melting temperature of the melt-blown fibers, and a collector for collecting the heat treated melt-blown fibers.

Various exemplary embodiments of the present disclosure are further illustrated by the following Listing of Exemplary Embodiments, which should not be construed to unduly limit the present disclosure:

Listing of Exemplary Embodiments

A. A process comprising:

a) forming a multiplicity of melt blown fibers by passing a molten stream comprising molecules of at least one thermoplastic semi-crystalline (co)polymer through a multiplicity of orifices of a melt-blowing die;

b) subjecting at least a portion of the melt blown fibers of step (a) to a controlled in-flight heat treatment operation immediately upon exit of the melt blown fibers from the multiplicity of orifices, wherein the controlled in-flight heat treatment operation takes place at a temperature below a melting temperature of the portion of the melt blown fibers for a time sufficient to achieve stress relaxation of at least a portion of the molecules within the portion of the fibers subjected to the controlled in-flight heat treatment operation; and c) collecting at least some of the portion of the melt blown fibers subjected to the controlled in-flight heat treatment operation of step (b) on a collector to form a non-woven fibrous structure, wherein the nonwoven fibrous structure exhibits a Shrinkage less than a Shrinkage measured on an identically-prepared structure that is not subjected to the controlled in-flight heat treatment operation of step (b).

B. A process comprising:

providing to a melt-blowing die a molten stream of a thermoplastic material comprising at least one thermoplastic semi-crystalline (co)polymer, wherein the thermoplastic material does not contain a nucleating agent in an amount effective to achieve nucleation;

melt-blowing the thermoplastic material into at least one fiber; and subjecting the at least one fiber immediately upon exiting the melt-blowing die and prior to collection as a nonwoven fibrous structure on a collector, to a controlled in-flight heat treatment operation at a temperature below a melting temperature of the at least one thermoplastic semi-crystalline (co)polymer for a time sufficient for the nonwoven fibrous structure to exhibit a Shrinkage less than a Shrinkage measured on an identically-prepared structure that is not subjected to the controlled in-flight heat treatment operation.

C. The process of any one of the preceding embodiments, wherein the at least one semi-crystalline (co)polymer comprises an aliphatic polyester (co)polymer, an aromatic polyester (co)polymer, or a combination thereof.

D. The process of embodiment C, wherein the semi-crystalline (co)polymer comprises poly(ethylene) terephthalate, poly(butylene) terephthalate, poly(ethylene) naphthalate, poly(lactic acid), poly(hydroxyl) butyrate, poly(trimethylene) terephthalate, or a combination thereof.

E. The process of embodiment C or D, wherein the at least one thermoplastic semi-crystalline (co)polymer comprises a blend of a polyester (co)polymer and at least one other (co)polymer to form a polymer blend.

F. The process of any one of the preceding embodiments, wherein the Shrinkage exhibited by the nonwoven fibrous structure subjected to the in-flight heat treatment operation is less than about 15%.

G. The process of any one of the preceding embodiments, wherein the controlled in-flight heat treatment operation subjects the at least one thermoplastic semi-crystalline (co) polymer to a temperature that is above a glass transition temperature of the at least one thermoplastic semi-crystalline (co)polymer.

H. The process of any one of the preceding embodiments, wherein the controlled in-flight heat treatment operation is carried out at a temperature of from about 80° C. to about 240° C.

I. The process of any one of the preceding embodiments, wherein the controlled in-flight heat treatment operation has a duration of at least about 0.001 second to no more than about 1.0 second.

J. The process of any one of the preceding embodiments, wherein the controlled in-flight heat treatment operation is carried out using radiative heating, natural convection heating, forced gas flow convection heating, or a combination thereof.

K. The process of embodiment J, wherein the controlled in-flight heat treatment operation is carried out using infrared radiative heating.

L. The process of any one of the preceding embodiments, wherein the nonwoven fibrous structure is selected from the group consisting of mats, webs, sheets, scrims, fabrics, and a combination thereof.

M. The process of any one of the preceding embodiments, wherein the melt blown fibers in the non-woven fibrous structure exhibit a median Fiber Diameter less than about 10 micrometers.

N. The process of any preceding embodiment, further comprising adding a multiplicity of particulates to the melt blown fibers before, during or after the in-flight heat treatment operation.

O. The process of any preceding embodiment, further comprising adding a multiplicity of non-melt blown fibers to the melt blown fibers before, during or after the in-flight heat treatment operation.

P. A non-woven fibrous structure prepared using the process of any one of the preceding embodiments.

Q. A nonwoven fibrous structure comprising:

a multiplicity of melt blown fibers comprising molecules of at least one thermoplastic semi-crystalline (co)polymer, wherein the thermoplastic material does not contain a nucleating agent in an amount effective to achieve nucleation, and further wherein the nonwoven fibrous structure is dimensionally stable and exhibits a Shrinkage less than 15%.

R. A nonwoven fibrous structure of embodiment Q, wherein the at least one semi-crystalline (co)polymer comprises an aliphatic polyester (co)polymer, an aromatic polyester (co) polymer, or a combination thereof.

S. A nonwoven fibrous structure of embodiment Q or R, wherein the semi-crystalline (co)polymer comprises poly (ethylene) terephthalate, poly(butylene) terephthalate, poly (ethylene) naphthalate, poly(lactic acid), poly(hydroxyl) butyrate, poly(trimethylene) terephthalate, or a combination thereof.

T. A nonwoven fibrous structure of any one of embodiments Q, R, or S, wherein the at least one thermoplastic semi-crystalline (co)polymer comprises a blend of a polyester (co)polymer and at least one other (co)polymer to form a polymer blend.

U. A nonwoven fibrous structure of any one of embodiments Q, R, S, or T, wherein the nonwoven fibrous structure is selected from the group consisting of mats, webs, sheets, scrims, fabrics, and a combination thereof.

V. A nonwoven fibrous structure of any one of embodiments Q, R, S, T, or U, wherein the melt blown fibers in the non-woven fibrous structure exhibit a median Fiber Diameter less than about 10 micrometers.

W. A nonwoven fibrous structure of any one of embodiments Q, R, S, T, U, or V, exhibiting a Solidity of from about 0.5% to about 12%.

X. A nonwoven fibrous structure of any one of embodiments Q, R, S, T, U, V, or W, exhibiting a basis weight of from 100 gsm to about 350 gsm.

Y. A nonwoven fibrous structure of any one of embodiments Q, R, S, T, U, V, W, or X, wherein a total heat flow curve obtained using Modulated Differential Scanning calorimetry (MDSC) on a first heating of the nonwoven fibrous structure shows a shift to a higher crystallization temperature when compared to a total heat flow curve obtained using MDSC on a first heating for an identically-prepared nonwoven fibrous structure without the in-flight heat treatment.

Z A nonwoven fibrous structure of embodiments Q, R, S, T, U, V, W, X, or Y, wherein a total heat flow curve obtained using MDSC on a first cooling after heating the nonwoven fibrous structure having the in-flight heat treatment to a temperature above a Nominal Melting Point, exhibits a shoulder on the cold crystallization peak positioned between the glass transition temperature and the Nominal Melting Point, when compared to a total heat flow curve obtained using MDSC on a first cooling after heating above the Nominal Melting Point for an identically-prepared nonwoven fibrous structure without the in-flight heat treatment.

AA. A nonwoven fibrous structure of any one of embodiments Q, R, S, T, U, V, W, X, Y, or Z, wherein the Compressive Strength, as measured using the test method disclosed herein, is greater than 1 kPa.

BB. A nonwoven fibrous structure of any one of embodiments Q, R, S, T, U, V, W, X, Y, Z, or AA, wherein the Maximum Load Tensile Strength, as measured using the test method disclosed herein, is greater than 10 Newtons.

CC. A nonwoven fibrous structure of any one of Q, R, S, T, U, V, W, X, Y, Z, AA, or BB, wherein the Apparent Crystallite Size, as measured using Wide Angle X-ray Scattering as disclosed herein, is from 30 Å to 50 Å, inclusive.

DD. A nonwoven fibrous structure of any one of embodiments Q, R, S, T, U, V, W, X, Y, Z, AA, BB, or CC, further comprising a multiplicity of particulates.

EE. A nonwoven fibrous structure of any one of embodiments Q, R, S, T, U, V, W, X, Y, Z, AA, BB, CC, or DD, further comprising a multiplicity of non-melt blown fibers, optionally wherein the non-melt blown fibers are staple fibers.

FF. An article comprising the nonwoven fibrous structure of any one of embodiments Q, R, S, T, U, V, W, X, Y, Z, AA, BB, CC, DD, or EE, wherein the article is selected from the group consisting of a thermal insulation article, an acoustic insulation article, a fluid filtration article, a wipe, a surgical drape, a wound dressing, a garment, a respirator, and a combination thereof.

GG. An apparatus comprising:

a melt-blowing die;

a means for controlled in-flight heat treatment of melt-blown fibers emitted from the melt-blowing die at a temperature below a melting temperature of the melt-blown fibers; and a collector for collecting the heat treated melt-blown fibers.

HH. The apparatus of embodiment GG, wherein the means for controlled in-flight heat treatment of melt-blown fibers emitted from the melt-blowing die is selected from the group consisting of a radiative heater, a natural convection heater, a forced gas flow convection heater, and combinations thereof.

II. The apparatus of embodiment HH, wherein the means for controlled in-flight heat treatment of melt-blown fibers emitted from the melt-blowing die is a radiative heater comprising at least one infrared heater.

BRIEF DESCRIPTION OF THE DRAWINGS

The disclosure may be more completely understood in consideration of the following detailed description of various embodiments of the disclosure in connection with the accompanying drawings, in which it is to be understood by one of ordinary skill in the art that the drawings illustrate certain exemplary embodiments only, and are not intended as limiting the broader aspects of the present disclosure.

Figure 1A:
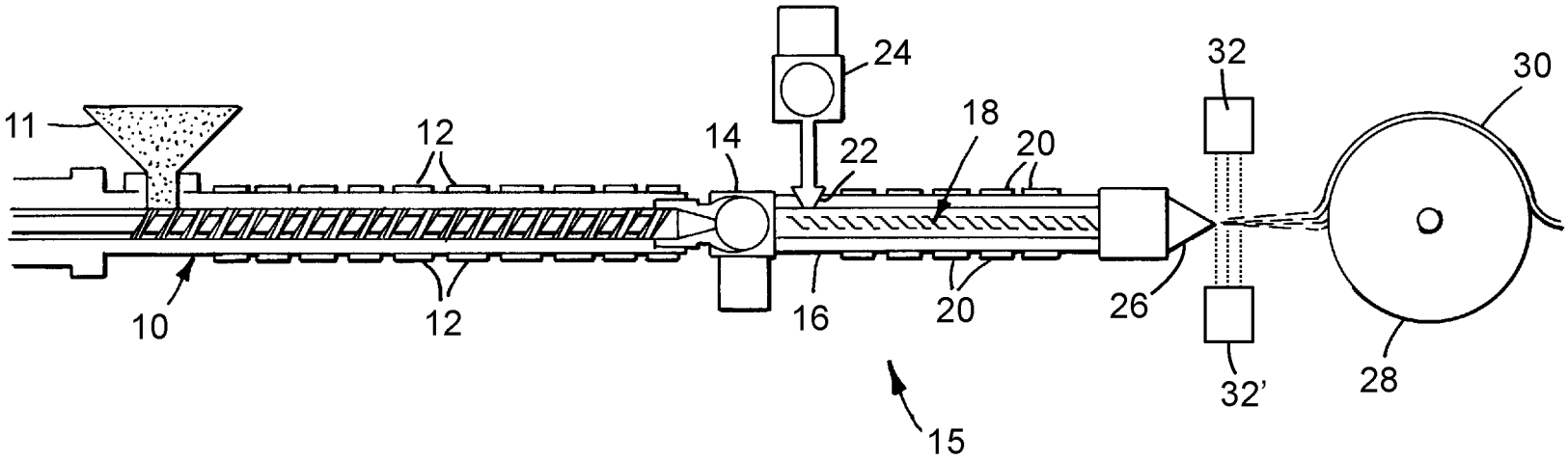
FIG. 1A is a schematic overall diagram of an exemplary apparatus for forming melt blown fibers and in-flight heat-treatment of the melt blown fibers of exemplary embodiments of the present disclosure.

Repeated use of reference characters in the specification and drawings is intended to represent the same or analogous features or elements of the disclosure. While the above-identified drawings, which may not be drawn to scale, set forth various embodiments of the present disclosure, other embodiments are also contemplated, as noted in the Detailed Description.

DETAILED DESCRIPTION

In the following detailed description, reference is made to the accompanying set of drawings that form a part of the description hereof and in which are shown by way of illustration several specific embodiments. It is to be understood that other embodiments are contemplated and may be made without departing from the scope or spirit of the present disclosure. The following detailed description, therefore, is not to be taken in a limiting sense.

Unless otherwise indicated, all numbers expressing feature sizes, amounts, and physical properties used in the specification and claims are to be understood as being modified in all instances by the term "about." Accordingly, unless indicated to the contrary, the numerical parameters set forth in the foregoing specification and attached claims are approximations that can vary depending upon the desired properties sought to be obtained by those skilled in the art utilizing the teachings disclosed herein. At the very least, and not as an attempt to limit the application of the doctrine of equivalents to the scope of the claimed embodiments, each numerical parameter should at least be construed in light of the number of reported significant digits and by applying ordinary rounding techniques. In addition, the use of numerical ranges with endpoints includes all numbers within that range (e.g. 1 to 5 includes 1, 1.5, 2, 2.75, 3, 3.80, 4, and 5) and any narrower range or single value within that range.

Glossary

Certain terms are used throughout the description and the claims that, while for the most part are well known, may require some explanation. It should be understood that, as used herein:

The terms "about," "approximate," or "approximately" with reference to a numerical value or a geometric shape means+/−five percent of the numerical value or the value of the internal angle between adjoining sides of a geometric shape having a commonly recognized number of sides, expressly including any narrower range within the +/−five percent of the numerical or angular value, as well as the exact numerical or angular value. For example, a temperature of "about" 100° C. refers to a temperature from 95° C. to 105° C., but also expressly includes any narrower range of temperature or even a single temperature within that range, including, for example, a temperature of exactly 100° C.

The term "substantially" with reference to a property or characteristic means that the property or characteristic is exhibited to within 2% of that property or characteristic, but also expressly includes any narrow range within the two percent range of the property or characteristic, as well as the exact value of the property or characteristic. For example, a substrate that is "substantially" transparent refers to a substrate that transmits 98-100% of incident light.

The terms "a", "an", and "the" include plural referents unless the content clearly dictates otherwise. Thus, for example, reference to a material containing "a compound" includes a mixture of two or more compounds.

The term "or" is generally employed in its sense including "and/or" unless the content clearly dictates otherwise.

The term "(co)polymer" means a relatively high molecular weight material having a molecular weight of at least about 10,000 g/mole (in some embodiments, in a range from 10,000 g/mole to 5,000,000 g/mole). The terms "(co)polymer" or "(co)polymers" includes homopolymers and copolymers, as well as homopolymers or copolymers that may be formed in a miscible blend, e.g., by co-extrusion or by reaction, including, e.g., transesterification. The term "(co) polymer" includes random, block and star (e.g. dendritic) (co)polymers.

The terms "melt-blowing" and "melt blown process" mean a method for forming a nonwoven fibrous web by extruding a molten fiber-forming material comprising one or more thermoplastic (co)polymer(s) through at least one or a plurality of orifices to form filaments while contacting the filaments with air or other attenuating fluid to attenuate the filaments into discrete fibers, and thereafter collecting the attenuated fibers. An exemplary meltblowing process is taught in, for example, U.S. Pat. No. 6,607,624 (Berrigan et al.).

The term "melt-blown fibers" means fibers prepared by a melt-blowing or melt blown process. The term is used in general to designate discontinuous fibers formed from one or more molten stream(s) of one or more thermoplastic (co) polymer(s) that are extruded from one or more orifice(s) of a melt-blowing die and subsequently cooled to form solidified fibers and webs comprised thereof. These designations are used for convenience of description only. In processes as described herein, there may be no firm dividing line between partially solidified fibers, and fibers which still comprise a slightly tacky and/or semi-molten surface.

The term "die" means a processing assembly including at least one orifice for use in polymer melt processing and fiber extrusion processes, including but not limited to melt-blowing.

The term "discontinuous" when used with respect to a fiber or collection of fibers means fibers having a finite aspect ratio (e.g., a ratio of length to diameter of e.g., less than about 10,000).

The term "oriented" when used with respect to a fiber means that at least portions of the (co)polymer molecules within the fibers are aligned with the longitudinal axis of the fibers, for example, by use of a drawing process or attenuator upon a stream of fibers exiting from a die.

The terms "nonwoven fibrous web" or "nonwoven web" mean a collection of fibers characterized by entanglement or point bonding of the fibers to form a sheet or mat exhibiting a structure of individual fibers or filaments which are interlaid, but not in an identifiable manner as in a knitted fabric.

The term "mono-component" when used with respect to a fiber or collection of fibers means fibers having essentially the same composition across their cross-section; mono-component includes blends (viz., (co)polymer mixtures) or additive-containing materials, in which a continuous phase of substantially uniform composition extends across the cross-section and over the length of the fiber.

The term "directly collected fibers" describes fibers formed and collected as a web in essentially one operation, by extruding molten fibers from a set of orifices and collecting the at least partially solidified fibers as fibers on a collector surface without the fibers or fibers contacting a deflector or the like between the orifices and the collector surface.

The term "pleated" describes a web wherein at least portions of which have been folded to form a configuration comprising rows of generally parallel, oppositely oriented folds. As such, the pleating of a web as a whole is distinguished from the crimping of individual fibers.

The term "self-supporting" with respect to a nonwoven fibrous structure (e.g., a nonwoven fibrous web, and the like) describes that the structure does not include a contiguous reinforcing layer of wire, mesh, or other stiffening material even if a pleated filter element containing such matrix may include tip stabilization (e.g., a planar wire face layer) or perimeter reinforcement (e.g., an edge adhesive or a filter frame) to strengthen selected portions of the filter element. Alternatively, or in addition, the term "self-supporting" describes a filter element that is deformation resistant without requiring stiffening layers, bi-component fibers, adhesive or other reinforcement in the filter media.

The term "web basis weight" is calculated from the weight of a 10 cm×10 cm web sample, and is usually expressed in grams per square meter (gsm).

The term "web thickness" is measured on a 10 cm×10 cm web sample using a thickness testing gauge having a tester foot with dimensions of 5 cm×12.5 cm at an applied pressure of 150 Pa.

The term "bulk density" is the mass per unit volume of the bulk polymer or polymer blend that makes up the web, taken from the literature.

The term "Solidity" is a nonwoven web property inversely related to density and characteristic of web permeability and porosity (low Solidity corresponds to high permeability and high porosity), and is defined by the equation:

$$\text{Solidity (\%)} = \frac{[3.937 * \text{Web Basis Weight (g/m}^2)]}{[\text{Web Thickness(mils)} * \text{Bulk Density (g/cm}^3)]}$$

The term "median Fiber Diameter" of fibers in a given nonwoven melt blown fibrous structure (e.g., web) or population of component is determined by producing one or more images of the fiber structure, such as by using a scanning electron microscope; measuring the fiber diameter of clearly visible fibers in the one or more images resulting in a total number of fiber diameters, x; and calculating the median fiber diameter of the x fiber diameters. Typically, x is greater than about 50, and desirably ranges from about 50 to about 2. However, in some cases, x may be selected to be as low as 30 or even 20. These lower values of x may be particularly useful for large diameter fibers, or for highly entangled fibers.

The term "Nominal Melting Point" for a (co)polymer or a (co)polymeric fiber or fibrous web corresponds to the temperature at which the peak maximum of a first-heat total-heat flow plot obtained using modulated differential scanning calorimetry (MDSC) as described herein, occurs in the melting region of the (co)polymer or fiber if there is only one maximum in the melting region; and, if there is more than one maximum indicating more than one Nominal Melting Point (e.g., because of the presence of two distinct crystalline phases), as the temperature at which the highest-amplitude melting peak occurs.

The term "particulate" and "particle" are used substantially interchangeably. Generally, a particulate or particle means a small distinct piece or individual part of a material in finely divided form. However, a particulate may also include a collection of individual particles associated or clustered together in finely divided form. Thus, individual particulates used in certain exemplary embodiments of the present disclosure may clump, physically intermesh, electrostatically associate, or otherwise associate to form particulates. In certain instances, particulates in the form of agglomerates of individual particulates may be intentionally formed such as those described in U.S. Pat. No. 5,332,426 (Tang et al.).

The term "porous" with reference to a melt-blown nonwoven fibrous structure or web means air-permeable. The term "porous" with reference to a particulate means gas- or liquid-permeable.

The term "particulate loading" or a "particle loading process" means a process in which particulates are added to a fiber stream or web while it is forming. Exemplary particulate loading processes are taught in, for example, U.S. Pat. No. 4,818,464 (Lau) and U.S. Pat. No. 4,100,324 (Anderson et al.).

The term "particulate-loaded media" or "particulate-loaded nonwoven fibrous web" means a nonwoven web having an open-structured, entangled mass of discrete fibers, containing particulates enmeshed within or bonded to the fibers, the particulates being chemically active.

The term "enmeshed" means that particulates are dispersed and physically held in the fibers of the web. Generally, there is point and line contact along the fibers and the particulates so that nearly the full surface area of the particulates is available for interaction with a fluid.

Various exemplary embodiments of the disclosure will now be described with particular reference to the Drawings. Exemplary embodiments of the present disclosure may take on various modifications and alterations without departing from the spirit and scope of the disclosure. Accordingly, it is to be understood that the embodiments of the present disclosure are not to be limited to the following described exemplary embodiments, but are to be controlled by the limitations set forth in the claims and any equivalents thereof.

The present disclosure describes a process and apparatus for making dimensionally stable melt blown nonwoven fibrous structures (e.g., mats, webs, sheets, scrims, fabrics, etc.) with fibers comprising, consisting essentially of, or consisting of one or a combination of polyester (co)polymers. Before the apparatus and process of the present disclosure, it was difficult to melt blow thermoplastic (co) polymer fibers comprising a polyester (co)polymer, especially such fibers having a diameter or thickness of less than about 10 micrometers. To melt blow such fibers, the corresponding thermoplastic polyester (co)polymer generally has to be heated to temperatures much higher than its Nominal Melting Point. Such elevated heating of the thermoplastic polyester (co)polymer can result in one or any combination of problems that can include, for example, excessive degradation of the (co)polymer, weak and brittle fiber webs, and formation of granular (co)polymeric material (commonly referred to as "sand") during melt-blowing. Even when melt blown polyester (co)polymer fibers are produced using convention processes, fibrous webs and other fibrous structures made with such fibers typically exhibit excessive shrinkage or otherwise poor dimensional stability at temperatures equal to or above the glass transition temperature of the polyester (co)polymer(s) used to make the fibers.

The present inventors have discovered a way to melt blow fibers and form melt blown nonwoven fibrous webs, using a thermoplastic (co)polymer comprising at least one thermoplastic semi-crystalline polyester (co)polymer, or a plurality of thermoplastic semi-crystalline polyester (co)polymers, where the fibers can be suitable for use at temperatures equal to or above the glass transition temperature of the polyester (co)polymer(s) used to make the fibers, even when the diameter of the fibers is less than about 10 micrometers. Such fibers may exhibit one or more desirable properties including, for example, one or any combination of: relatively low cost (e.g., manufacturing and/or raw material costs), durability, reduced shrinkage from heat exposure, increased dimensional stability at elevated temperature, and flame retardant properties. The present disclosure can also be used to provide environmentally friendlier non-halogenated flame retardant polyester based nonwoven or woven fibrous materials.

Because they are made with polyester containing (co) polymer materials that are dimensionally stable at elevated temperatures, non-woven fibrous structures (e.g., mats, webs, sheets, scrims, fabrics, etc.) made with such fibers, and articles (e.g., thermal and acoustic insulation and insulating articles, liquid and gas filters, garments, and personal protection equipment) made from such fibrous structures, can be used in relatively high temperature environments while exhibiting only minor, if any, amounts of shrinkage. The development of dimensionally stable polyester blown micro-fiber webs which will not shrink significantly upon exposure to heat as provided by embodiments of the present disclosure, widens the usefulness and industrial applicability of such webs. Such melt blown micro-fiber webs can be particularly useful as thermal insulation articles and high temperature acoustical insulation articles.

Apparatus

Thus, in exemplary embodiments, the present disclosure provides an apparatus including a melt-blowing die, a means for controlled in-flight heat treatment of melt-blown fibers emitted from the melt-blowing die at temperature below a melting temperature of the melt blown fibers, and a collector for collecting the in-flight heat treated melt-blown fibers.

Referring now to FIG. 1*a*, a schematic overall side view of an illustrative apparatus 15 for carrying out embodiments of the present disclosure is shown as a direct-web production method and apparatus, in which a fiber-forming (co)polymeric material is converted into a web in one essentially direct operation. The apparatus 15 consists of a conventional blown micro-fiber (BMF) production configuration as taught, for example, in van Wente, "Superfine Thermoplastic Fibers", *Industrial Engineering Chemistry*, Vol. 48, pages 1342 et sec (1956), or in Report No. 4364 of the Naval Research Laboratories, published May 25, 1954 entitled "Manufacture of Superfine Organic Fibers" by van Wente, A., Boone, C. D., and Fluharty, E. L. The configuration consists of an extruder 10 having a hopper 11 for pellets or powdered (co)polymer resin and a series of heating jackets 12 which heat the extruder barrel to melt the (co)polymer resin to form a molten (co)polymer. The molten (co)polymer exits from the extruder barrel into a pump 14, which permits improved control over the flow of the molten (co)polymer through the downstream components of the apparatus.

Optionally, upon exiting from the pump 14, the molten (co)polymer flows into an optional mixing means 15 including a conveying tube 16 which contains, for example, a mixing means such as a KENIX type static mixer 18. A series of heating jackets 20 control the temperature of the molten (co)polymer as it passes through the conveying tube 16. The mixing means 15 also optionally includes an injection port 22 near the inlet end of the conveying tube that is connected to an optional high pressure metering pump 24 which enables optional additives to be injected into the molten (co)polymer stream as it enters the static mixer 18.

After exiting from the optional conveying tube 16, the molten (co)polymer stream is delivered through a melt-blowing (BMF) die 26 comprising at least one orifice through which a stream of the molten (co)polymer is passed while simultaneously impinging on the (co)polymer stream a high velocity hot air stream which acts to draw out and attenuate the molten (co)polymer stream into micro-fibers.

Figure 1B:
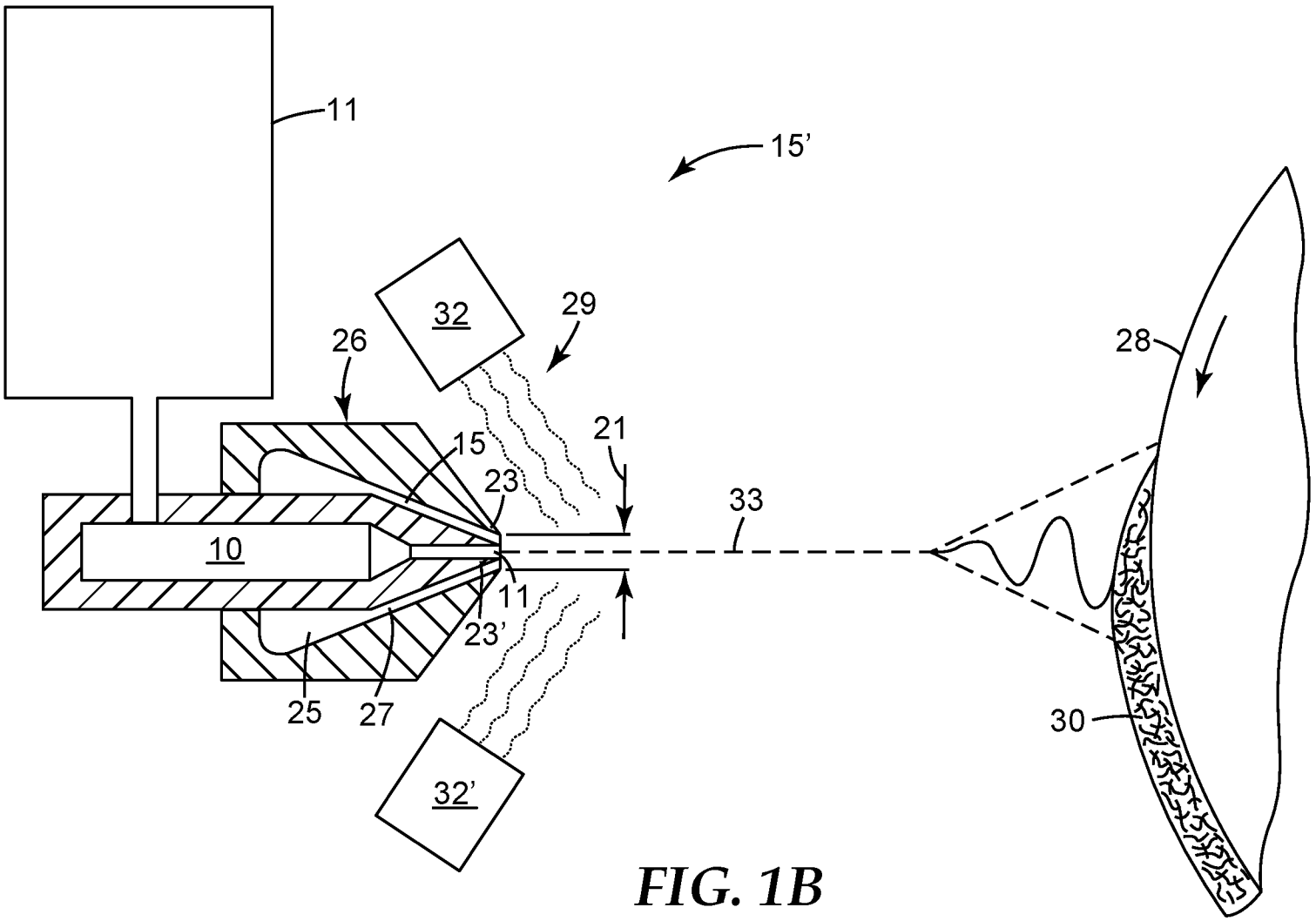
FIG. 1B is a schematic overall diagram of another exemplary apparatus for forming melt blown fibers and in-flight heat-treatment of the melt blown fibers of exemplary embodiments of the present disclosure.

Referring now to FIG. 1*b*, a schematic overall side view of another illustrative apparatus for carrying out embodiments of the present disclosure is shown as a direct-web production method and apparatus 15', in which a fiber-forming molten (co)polymeric material is converted into a web in one essentially direct operation. The apparatus 15' consists of a conventional blown micro-fiber (BMF) production configuration as taught, for example, in van Wente, described above. The configuration consists of an extruder 10 having a hopper 11 for pellets or powdered (co)polymer resin, which heats the (co)polymer resin to form a molten stream of (co)polymer resin. The molten stream of (co) polymer resin passes into a melt-blowing (BMF) die 26 comprising at least one orifice 11 through which a stream 33 of the molten (co)polymer is passed while simultaneously impinging on the exiting (co)polymer stream 33, high velocity hot air streams formed by passing gas from a gas supply manifold 25, through gas inlets 15, exiting the die 26 at gas jets 23 and 23', which act to draw out and attenuate the molten (co)polymer stream into micro-fibers. The velocity of the gas jets may be controlled, for example, by adjusting the pressure and/or flow rate of the gas stream, and/or by controlling the gas inlet dimension 27 (i.e., gap).

In either of the apparatus or processes shown in FIG. 1*a* or 1*b*, immediately upon exiting the at least one orifice 11 of the melt-blowing die 15 or 15', the molten (co)polymer fiber stream is subjected to a controlled in-flight heat treatment at a temperature below a melting temperature of the at least one thermoplastic semi-crystalline (co)polymer making up the fibers, using a means 32 and/or 32', for controlled in-flight heat treatment. In some exemplary embodiments, the means 32 and/or 32' for controlled in-flight heat treatment of melt-blown fibers emitted from the melt-blowing die is selected from a radiative heater, a natural convection heater, a forced gas flow convection heater, and combinations thereof.

In some exemplary embodiments, the means for controlled in-flight heat treatment of melt-blown fibers emitted from the melt-blowing die is one or more forced gas flow convection heaters 32 and/or 32', positioned to directly or indirectly (e.g., using entrained ambient air) impinge on the melt-blown fiber stream immediately upon exiting the melt-blowing die 26, as illustrated in FIG. 1*b*. In certain exemplary embodiments, the means for controlled in-flight heat treatment of melt-blown fiber stream immediately upon exiting the melt-blowing die 26 is one or more radiative heaters 32 and/or 32' as shown in FIG. 1*a* (e.g., at least one infrared heater, for example a quartz lamp infrared heater as described in the Examples).

By "immediately upon exiting from the melt-blowing die," we mean that the controlled in-flight heat treatment of the melt-blown fibers occurs within a heat treatment distance 21 from the extending from the at least one orifice 11 through which the stream 33 of the molten (co)polymer is passed. The heat treatment distance 21 may be as short as 0 mm, 0.1 mm, 0.2 mm, 0.3 mm, 0.5 mm, 0.6 mm, 0.7 mm, 0.8 mm, 0.9 mm, or even 1 mm. Preferably, the heat treatment distance is no more than 50 mm, 40 mm, 30 mm, 20 mm, 10 mm, or even 5 mm. Preferably, the total distance of heat treatment is from 0.1 to 50 mm, 0.2 to 49 mm, 0.3 to 48 mm, 0.4 to 47 mm, 0.4 to 46 mm, 0.5 to 45 mm, 0.6 to 44 mm, 0.7 to 43 mm, 0.8 to 42 mm, 0.9 to 41 mm, or even 1 mm or greater to 40 mm or less.

During and after in-flight heat treatment, the micro-fibers begin to solidify, and thus form a cohesive web 30 as they arrive at a collector 28. This method is particularly preferred in that it produces fine diameter fibers that can be directly formed into a melt blown nonwoven fibrous web without the need for subsequent bonding processes.

Process

In further exemplary embodiments, the disclosure provides a process comprising:

a) forming a plurality of melt blown fibers by passing a molten stream comprising molecules of at least one thermoplastic semi-crystalline (co)polymer through a plurality of orifices of a melt-blowing die;

b) subjecting at least a portion of the melt blown fibers of step (a) to a controlled in-flight heat treatment operation immediately upon exit of the melt blown fibers from the plurality of orifices, wherein the controlled in-flight heat treatment operation takes place at a temperature below a melting temperature of the portion of the melt-blown fibers for a time sufficient to achieve stress relaxation of at least a portion of the molecules within the portion of the fibers subjected to the controlled in-flight heat treatment operation; and c) collecting at least some of the portion of the melt blown fibers subjected to the controlled in-flight heat treatment operation of step (b) on a collector to form a non-woven fibrous structure, wherein the nonwoven fibrous structure exhibits a Shrinkage (as measured using the methodology described herein) less than a Shrinkage measured on an identically-prepared structure that is not subjected to the controlled in-flight heat treatment operation of step (b).

In other exemplary embodiments, the disclosure provides a process comprising:

providing to a melt-blowing die a molten stream of a thermoplastic material comprising at least one thermoplastic semi-crystalline (co)polymer, wherein the thermoplastic material does not contain a nucleating agent in an amount effective to achieve nucleation;

melt-blowing the thermoplastic material into at least one fiber; and subjecting the at least one fiber, immediately upon exiting the melt-blowing die and prior to collection as a nonwoven fibrous structure on a collector, to a controlled in-flight heat treatment operation at a temperature below a melting temperature of the at least one thermoplastic semi-crystalline (co)polymer for a time sufficient for the nonwoven fibrous structure to exhibit a Shrinkage (as measured using the methodology described herein) less than a Shrinkage measured on an identically-prepared structure that is not subjected to the controlled in-flight heat treatment operation.

Melt-Blowing Process

In the melt-blowing process, the thermoplastic (co)polymer material is melted to form a molten (co)polymer material, which is then extruded through one or more orifices of a melt-blowing die. In some exemplary embodiments, the melt-blowing process can include forming (e.g., extruding) the molten (co)polymer material into at least one or a plurality of fiber preforms which is then passed through at least one orifice of a melt-blowing die and solidified (e.g., by cooling) the at least one fiber preform into the at least one fiber. The thermoplastic (co)polymer material is generally still molten when the preform is made and passed through at least one orifice of the melt-blowing die.

In any of the foregoing processes, the melt-blowing should be performed within a range of temperatures hot enough to enable the thermoplastic (co)polymer material to be melt blown but not so hot as to cause unacceptable deterioration of the thermoplastic (co)polymer material. For example, the melt-blowing can be performed at a temperature that causes the thermoplastic (co)polymer material to reach a temperature in the range of from at least about 200° C., 225° C., 250° C., 260° C., 270° C., 280° C., or even at least 290° C.; to less than or equal to about 360° C., 350° C., 340° C., 330° C., 320° C., 310° C., or even 300° C.

Controlled In-Flight Heat Treatment Process

The controlled in-flight heat treatment operation may be carried out using radiative heating, natural convection heating, forced gas flow convection heating, or a combination thereof. Suitable radiative heating may be provided, for example, using infrared or halogen lamp heating systems. Suitable infrared (e.g., quartz lamp) radiative heating systems may be obtained from Research, Inc. of Eden Prairie, Minn.; Infrared Heating Technologies, LLC, Oak Ridge, Tenn.; and Roberts-Gordon, LLC, Buffalo, N.Y. Suitable forced gas flow convection heating systems may be obtained from Roberts-Gordon, LLC, Buffalo, N.Y.; Applied Thermal Systems, Inc., Chattanooga, Tenn.; and from Chromalox Precision Heat and Control, Pittsburgh, Pa.

Generally the in-flight heat treatment is carried out at a temperature of from at least about 50° C., 70° C., 80° C., 90° C., 100° C.; to at most about 340° C., 330° C., 320° C., 310° C., 300° C., 275° C., 250° C., 225° C., 200° C., 175° C., 150° C., 125° C., or even 110° C.

Generally, the controlled in-flight heat treatment operation has a duration of at least about 0.001 second, 0.005 second, 0.01 second, 0.05 second, 0.1 second, 0.5 second or even 0.75 second; to no more than about 1.5 seconds, 1.4 seconds, 1.3 seconds, 1.2 seconds, 1.1 seconds, 1.0 second, 0.9 second, or even 0.8 second.

As noted above, the preferred temperature at which in-flight heat treatment is carried out will depend, at least in part, on the thermal properties of the (co)polymer(s) which make up the fibers. In some exemplary embodiments, the (co)polymer(s) include at least one semi-crystalline (co)polymer selected from an aliphatic polyester (co)polymer, an aromatic polyester (co)polymer, or a combination thereof. In certain exemplary embodiments, the semi-crystalline (co)polymer comprises poly(ethylene) terephthalate, poly(butylene) terephthalate, poly(ethylene) naphthalate, poly(lactic acid), poly(hydroxyl) butyrate, poly(trimethylene) terephthalate, or a combination thereof. In certain exemplary embodiments, the at least one thermoplastic semi-crystalline (co)polymer comprises a blend of a polyester (co)polymer and at least one other (co)polymer to form a polymer blend.

In any of the foregoing embodiments, the controlled in-flight heat treatment operation generally subjects the at least one thermoplastic semi-crystalline (co)polymer(s) to a temperature that is above a glass transition temperature of the at least one thermoplastic semi-crystalline (co)polymer(s). In some exemplary embodiments, the controlled in-flight heat treatment operation prevents the at least one thermoplastic semi-crystalline (co)polymer(s) from cooling below their respective glass transition temperatures for a time sufficient for at least some degree of stress relaxation of the (co)polymer molecules to occur.

Without wishing to be bound by any particular theory, it is currently believed that when the in-flight heat treatment process is used to treat semi-crystalline (co)polymeric fibers emitted from a melt-blowing die immediately upon exiting the die orifice(s), the (co)polymer molecules within the melt blown fibers undergo stress relaxation immediately upon exiting the die orifices, while still in a molten or semi-molten state. The melt-blown fibers are thereby morphologically refined to yield fibers with new properties and utility compared to identical melt-blown fibers without the in-flight heat treatment.

In broadest terms "stress relaxation" as used herein means simply changing the morphology of oriented semi-crystalline (co)polymeric fibers; but we understand the molecular structure of one or more of the (co)polymer(s) in the in-flight heat treated fibers of the present disclosure as follows (we do not wish to be bound by statements herein of our "understanding," which generally involve some theoretical considerations).

The orientation of the (co)polymer chains in the fibers and the degree of stress relaxation of the semi-crystalline thermoplastic (co)polymer molecules within the fibers achieved by in-flight heat treating as described in the present disclosure can be influenced by selection of operating parameters, such as the nature of the (co)polymeric material used, the temperature of the air stream introduced by the air knives which act to fibrillate the polymer streams exiting the orifices, the temperature and duration of in-flight heat treating of the melt blown fibers, the fiber stream velocity, and/or the degree of solidification of the fibers at the point of first contact with the collector surface, We currently believe that the stress relaxation achieved by in-flight heat treatment according to the present disclosure may act to reduce the number and/or increase the size of nucleii or "seeds" which act to induce crystallization of the (co)polymeric materials making up the nonwoven fibers. Classical nucleation theories, such as the theory of F. L.

Binsbergen ("Natural and Artificial Heterogeneous Nucleation in Polymer Crystallization, Journal of Polymer Science: Polymer Symposia, Volume 59, Issue 1, pages 11-29 (1977)), teach that various fiber formation process parameters, for example, temperature history/heat treatment, quench cooling, mechanical action, or ultrasonic, acoustic or ionizing radiation treatments, generally result in a semi-crystalline material, such as PET, forming fibers in which crystalline nucleation is enhanced in the region between the glass transition and the onset of cold crystallization. Such conventionally prepared fibrous materials "show abundant nucleation" when heated to even 10° C. above the glass transition of the (co)polymer material comprising the fibers.

In contrast, web materials prepared using the in-flight heat treatment process of the present disclosure typically show a delay or reduction in the onset of cold crystallization when heated above the glass transition temperature. This delay or reduction in the onset of cold crystallization when the in-flight heat treated fibers are heated above their glass transition temperature also is frequently observed to reduce heat-induced shrinkage of nonwoven fibrous webs comprising such in-flight heat treated fibers.

Thus, in some exemplary embodiments of this in-flight heat treatment process, the fibers, immediately after exiting from a melt blown die orifice, are maintained at a rather high temperature for a short controlled time period while remaining in-flight. Generally, the fibers are subjected in-flight to a temperature higher than the glass transition temperature of the (co)polymeric material which makes up the fibers, and in some embodiments, as high or higher than the Nominal Melting Point of the (co)polymeric material from which the fibers are made, and for a time sufficient to achieve at least some degree of stress relaxation of the (co)polymer molecules which comprise the fibers.

Further, in certain exemplary embodiments, the in-flight heat treatment process is believed to influence the crystallization behavior and average crystallite size for slow-crystallizing materials such as PET and PLA, thereby altering the shrinkage behavior of nonwoven fibrous webs comprising these materials when heated above their glass transition temperatures. Such in-situ refining and reduction of the polymer nucleation site density within the (co) polymeric material which makes up the in-flight heat treated fibers, is believed to reduce the polymer nucleation population by removing the smaller size crystalline "seeds" in the (co)polymer via physical (heat) or chemical changes (e.g., cross-linking) in the (co)polymer chains, thereby resulting in a more thermally stable web exhibiting reduced heat shrinkage.

This improved, low shrinkage behavior is believed to be due, at least in part, to the delaying of crystallization during subsequent heat exposure or processing, possibly due to stronger (co)polymer chain-chain alignment generated by the reduction in the level of crystalline nuclei or "seed" structures present in the (co)polymer, which disrupt molecular order. This in-situ reduction in the number or increase in the size of crystal nuclei or "seeds" is believed to result in a nonwoven fibrous web which has a relatively low level of crystallinity as made, yet is more dimensionally stable at higher temperatures, particularly when heated to a temperature at or above the glass transition temperature ($T_g$), and more particularly at or above the cold-crystallization temperature ($T_{cc}$), for the (co)polymeric material which makes up the fibers.

Optional Process Steps

The chaotic stream of molten (co)polymer emitted from one or more orifices of a melt-blowing die produced by the foregoing processes can easily incorporate discrete non-melt blown fibers or particulates that are introduced into the fibrous stream during or after in-flight heat treatment of the melt blown fibers.

Thus, in some exemplary embodiments, the process further comprises adding a plurality of particulates to the melt blown fibers before, during or after the in-flight heat treatment operation. In further exemplary embodiments, the process additionally or alternatively comprises adding a plurality of non-melt blown fibers to the melt blown fibers during or after the in-flight heat treatment operation.

In particular, the optional particulates and/or non-melt blown fibers may be advantageously added during in-flight heat treatment, or during collection as a melt blown nonwoven fibrous web, e.g. as disclosed in U.S. Pat. No. 4,100,324. These added non-melt blown fibers or particulates can become entangled in the fibrous matrix without the need for additional binders or bonding processes. These added non-melt blown fibers or particulates can be incorporated to add additional characteristics to the melt blown nonwoven fibrous web, for example, loft, abrasiveness, softness, anti-static properties, fluid adsorption properties, fluid absorption properties, and the like.

Various processes conventionally used as adjuncts to fiber-forming processes may be used in connection with fibers as they exit from one or more orifices of the belt blowing die. Such processes include spraying of finishes, adhesives or other materials onto the fibers, application of an electrostatic charge to the fibers, application of water mists to the fibers, and the like. In addition, various materials may be added to a collected web, including bonding agents, adhesives, finishes, and other webs or films. For example, prior to collection, extruded fibers or fibers may be subjected to a number of additional processing steps not illustrated in FIG. 1, e.g., further drawing, spraying, and the like.

In some particular embodiments, the melt blown fibers may be advantageously electrostatically charged. Thus, in certain exemplary embodiments, the melt blown fibers may be subjected to an electret charging process. An exemplary electret charging process is hydro-charging. Hydrocharging of fibers may be carried out using a variety of techniques including impinging, soaking or condensing a polar fluid onto the fiber, followed by drying, so that the fiber becomes charged. Representative patents describing hydro-charging include U.S. Pat. Nos. 5,496,507; 5,908,598; 6,375,886 B1; 6,406,657 B1; 6,454,986 and 6,743,464 B1. Preferably water is employed as the polar hydro-charging liquid, and the media preferably is exposed to the polar hydro-charging liquid using jets of the liquid or a stream of liquid droplets provided by any suitable spray means.

Devices useful for hydraulically entangling fibers are generally useful for carrying out hydro-charging, although the operation is carried out at lower pressures in hydro-charging than generally used in hydro-entangling. U.S. Pat. No. 5,496,507 describes an exemplary apparatus in which jets of water or a stream of water droplets are impinged upon the fibers in web form at a pressure sufficient to provide the subsequently-dried media with a filtration-enhancing electret charge.

The pressure necessary to achieve optimum results may vary depending on the type of sprayer used, the type of polymer from which the fiber is formed, the thickness and density of the web, and whether pretreatment such as corona charging was carried out before hydro-charging. Generally, pressures in the range of about 69 kPa to about 3450 kPa are suitable. Preferably, the water used to provide the water droplets is relatively pure. Distilled or deionized water is preferable to tap water.

The electret fibers may be subjected to other charging techniques in addition to or alternatively to hydro-charging, including electrostatic charging (e.g., as described in U.S. Pat. Nos. 4,215,682, 5,401,446 and 6,119,691), tribo-charging (e.g., as described in U.S. Pat. No. 4,798,850) or plasma fluorination (e.g., as described in U.S. Pat. No. 6,397,458 B1). Corona charging followed by hydro-charging and plasma fluorination followed by hydro-charging are particularly suitable charging techniques used in combination.

After collection, the collected mass 30 may additionally or alternatively be wound into a storage roll for later processing if desired. Generally, once the collected melt blown nonwoven fibrous web 30 has been collected, it may be conveyed to other apparatus such as calendars, embossing stations, laminators, cutters and the like; or it may be passed through drive rolls and wound into a storage roll.

Other fluids that may be used include water sprayed onto the fibers, e.g., heated water or steam to heat the fibers, and relatively cold water to quench the fibers.

Nonwoven Fibrous Structures

The apparatus and process of the present disclosure provide, in exemplary embodiments, new dimensionally stable melt blown nonwoven fibrous structures comprising (co)polymeric thermoplastic fibers that are bonded to form coherent and handleable webs.

The nonwoven fibrous structure may take a variety of forms, including mats, webs, sheets, scrims, fabrics, and a combination thereof. Following in-flight heat treatment and collection of the melt-blown fibers as a nonwoven fibrous structure, the nonwoven fibrous structure exhibits a Shrinkage (as determined using the Shrinkage test method described below) less than about 15%, 14%, 13%, 12%, 11%, 10%, 9%, 8%, 7%, 6%, 5%, 4%, 3%, 2% or even 1%.

Melt-Blown Fibers

Melt-blown nonwoven fibrous structures or webs of the present disclosure generally include melt-blown fibers that may be regarded as discontinuous fibers. However, depending on the operating parameters chosen, e.g., degree of solidification from the molten state, the collected fibers may be semi-continuous or essentially discontinuous.

In certain exemplary embodiments, the melt-blown fibers of the present disclosure may be oriented (i.e., molecularly oriented).

The melt-blown fibers in the non-woven fibrous structures or webs may exhibit a median Fiber Diameter (determined using the test method described below) less than about 10 micrometers (μm), 9 μm, 8 μm, 7 μm, 5 μm, 4 μm, 3 μm, 2 μm, or even 1 μm.

Melt-Blown Fiber Components

Melt-blown nonwoven fibrous structures or webs of the present disclosure generally comprise at least one semi-crystalline (co)polymer.

Semi-Crystalline (Co)Polymers

The at least one semi-crystalline (co)polymer may, in exemplary embodiments, comprise an aliphatic polyester (co)polymer, an aromatic polyester (co)polymer, or a combination thereof. The semi-crystalline (co)polymer comprises, in certain exemplary embodiments, poly(ethylene) terephthalate, poly(butylene) terephthalate, poly(ethylene) naphthalate, poly(lactic acid), poly(hydroxyl) butyrate, poly (trimethylene) terephthalate, or a combination thereof.

In other exemplary embodiments, the nonwoven fibrous structure of any one of the foregoing embodiments comprises fibers comprising at least one thermoplastic semi-crystalline (co)polymer which comprises a blend of a polyester (co)polymer and at least one other (co)polymer to form a polymer blend.

Generally, any semi-crystalline fiber-forming (co)polymeric material may be used in preparing fibers and webs of the present disclosure. The thermoplastic (co)polymer material can comprise a blend of a polyester polymer and at least one other polymer to form a polymer blend of two or more polymer phases. It can be desirable for the polyester polymer to be an aliphatic polyester, aromatic polyester or a combination of an aliphatic polyester and aromatic polyester.

The thermoplastic polyester (co)polymer can form the only, a majority, or at least a substantial polymer portion or phase of the thermoplastic (co)polymer material. The polyester (co)polymer forms a substantial portion of the thermoplastic (co)polymer material, when the thermoplastic (co)polymer material can be melt blown and the resulting fiber(s) exhibits acceptable mechanical properties and thermal properties. For example, a polyester (co)polymer content of at least about 70% by volume can form a substantial polymer portion or phase of the thermoplastic (co)polymer material.

Acceptable mechanical properties or characteristics can include, e.g., tensile strength, initial modulus, thickness, etc. The fiber can be seen as exhibiting acceptable thermal properties, e.g., when a non-woven web made from the fibers exhibits less than about 30, 25, 20 or 15 percent, and generally less than or equal to about 10 or 5 percent, linear shrinkage when heated to a temperature of about 150° C. for about 4 hours.

Suitable polyester (co)polymers include poly(ethylene) terephthalate (PET), poly(lactic acid) (PLA), poly(ethylene) naphthalate (PEN), and combinations thereof. The specific polymers listed here are examples only, and a wide variety of other (co)polymeric or fiber-forming materials are useful.

Fibers also may be formed from blends of materials, including materials into which certain additives have been added, such as pigments or dyes. Bi-component fibers, such as core-sheath or side-by-side bi-component fibers, may be used ("bi-component" herein includes fibers with two or more components, each occupying a separate part of the cross-section of the fiber and extending over the length of the fiber).

However, the present disclosure is most advantageous with mono-component fibers, which have many benefits (e.g., less complexity in manufacture and composition; "mono-component" fibers have essentially the same composition across their cross-section; mono-component includes blends or additive-containing materials, in which a continuous phase of uniform composition extends across the cross-section and over the length of the fiber) and can be conveniently bonded and given added bondability and shapeability by the present disclosure.

In some exemplary embodiments of the present disclosure, different fiber-forming materials may be extruded through different orifices of the extrusion head so as to prepare webs that comprise a mixture of fibers. In further exemplary embodiments, other materials are introduced into a stream of fibers prepared of the present disclosure before or as the fibers are collected so as to prepare a blended web. For example, other staple fibers may be blended in the manner taught in U.S. Pat. No. 4,118,531; or particulate material may be introduced and captured within the web in the manner taught in U.S. Pat. No. 3,971,373; or microwebs as taught in U.S. Pat. No. 4,813,948 may be blended into the webs. Alternatively, fibers prepared by the present disclosure may be introduced into a stream of other fibers to prepare a blend of fibers.

Fibers of substantially circular cross-section are most often prepared, but other cross-sectional shapes may also be used. In general, the fibers having a substantially circular cross-section prepared using a method of the present disclosure may range widely in diameter. Micro-fiber sizes (about 10 micrometers or less in diameter) may be obtained and offer several benefits; but fibers of larger diameter can also be prepared and are useful for certain applications; often the fibers are 20 micrometers or less in diameter. It can be commercially desirable for the fiber diameter to be less than or equal to about 9, 8, 7, 6 or even 5 microns or less. It can even be commercially desirable for the fiber diameter to be 4, 3, 2 or 1 micron or smaller.

Thus, in one an exemplary melt-blowing process of the present disclosure, a thermoplastic (co)polymer material is provided that comprises at least one or a plurality of semi-crystalline polyester (co)polymers (such as, e.g., PET, PEN, PBT, PLA and possibly PHB and PTT). This thermoplastic (co)polymer material is melt blown into a plurality of fibers, with each fiber having a diameter or thickness that is less than about 10 microns.

Modulated Differential Scanning Calorimetry (MDSC) Fiber Characteristics

One useful tool for examining changes occurring within fibers treated using in-flight heat treatment according to the present disclosure, is modulated differential scanning calorimetry (MDSC), described further below. Generally, a test sample (e.g., a small section of the test web) is subjected to a first heating and cooling cycle in the MDSC equipment: a "first heat," which heats the test sample as received to a temperature greater than the Nominal Melting Point of the sample (as determined by the heat flow signal returning to a stable base line); a "first cool," which subsequently cools the "first heat" test sample from a temperature above the Nominal Melting Point to a temperature less than the glass transition temperature of the sample, typically to a temperature lower than room temperature (e.g., about 10° C.). The first heat measures characteristics of a nonwoven fibrous web of the present disclosure directly after its formation, i.e., without it having experienced additional thermal treatment. The first cool measures the crystallization (or rather recrystallization) characteristics of the nonwoven fibrous web of the present disclosure after the first heat.

Figure 2:
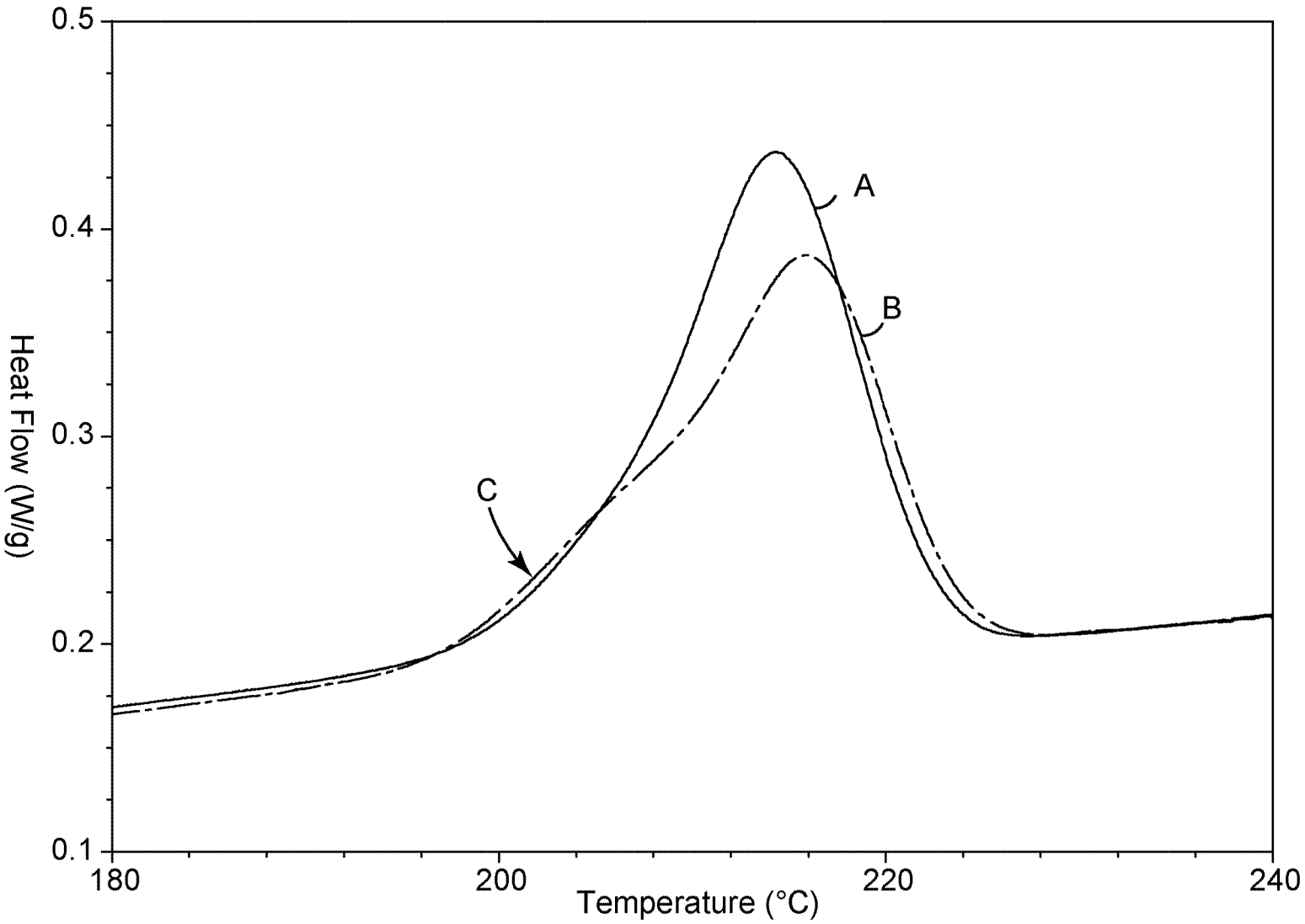
FIG. 2 is a plot of the total heat flow curves resulting from a first cooling after heating the nonwoven fibrous webs of Example 1 (with in-flight heat treatment) and Comparative Example A (without in-flight heat treatment)) to a temperature above the Nominal Melting Point using MDSC according to exemplary embodiments of the present disclosure.

Representative MDSC data are shown in FIGS. 2, and 3A-3C. Among other things, MDSC testing produces three different plots or signal traces as shown in FIGS. 2-3 (On all the MDSC plots presented herein the abscissa is marked in units of temperature, degrees Centigrade; the ordinates are in units of thermal energy, watts/gram; and heat evolution or exothermic behavior is shown by upward deflections (e.g. peaks) of the plotted curves).

The leftmost ordinate scale in FIGS. 2-3 is for the total heat flow plot; the inner right ordinate scale (if shown) is for the non-reversing heat flow plot; and the rightmost ordinate scale (if shown) is for the reversing heat flow plot. Each separate plot reveals different Distinguishing MDSC Characteristics useful in characterizing melt-blown fibers and nonwoven melt-blown fibrous structures (e.g., webs) of the present disclosure.

Some of the more or less discernible distinguishing MDSC Characteristics take the form of deflections or shifts of peaks that may appear on the MDSC plots at different temperatures depending on the (co)polymeric composition of a fiber being tested and the condition of the fiber (the result of processes or exposures the fiber has experienced), which are illustrated, for example, in FIGS. 2 and 3A-3C.

Thus, in certain exemplary embodiments exemplified by FIG. 2 Plot B, the first-cool, total-heat-flow plot of MDSC data, obtained for a representative semi-crystalline (co) polymer fiber subjected to in-flight heat treatment (Example 1), after first heating the fiber above the Nominal Melting Point, reveals a discernible "shoulder" C on the exothermic peak near the Nominal Melting Point of the total-heat-flow plot, reflecting a delay in the onset of crystallization on cooling for the in-flight heat treated fiber. This "shoulder," believed to reflect a delay in the onset of crystallization on cooling the fiber from a temperature above the Nominal Melting Point, is absent from the first cool, total-heat-flow plot of the MDSC data obtained on an identically-prepared melt blown nonwoven fibrous web in which the melt blown fibers were not subject to in-flight heat treatment (Comparative Example A, Plot A).

Figure 3A:
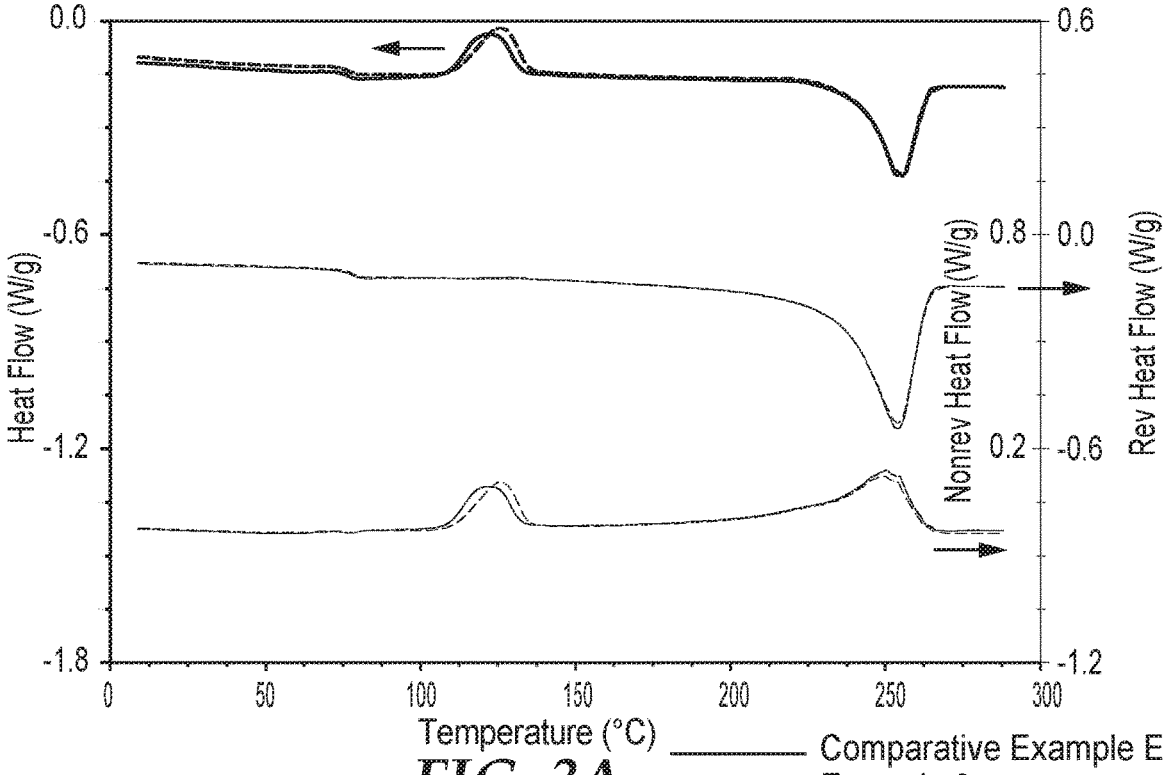
FIG. 3A is a plot of the total, reversible and non-reversible heat flow curves resulting from a first heating using MDSC of the collected nonwoven fibrous webs of Example 9 (with in-flight heat treatment) and Comparative Example E (without in-flight heat treatment), according to exemplary embodiments of the present disclosure.
Figure 3B:
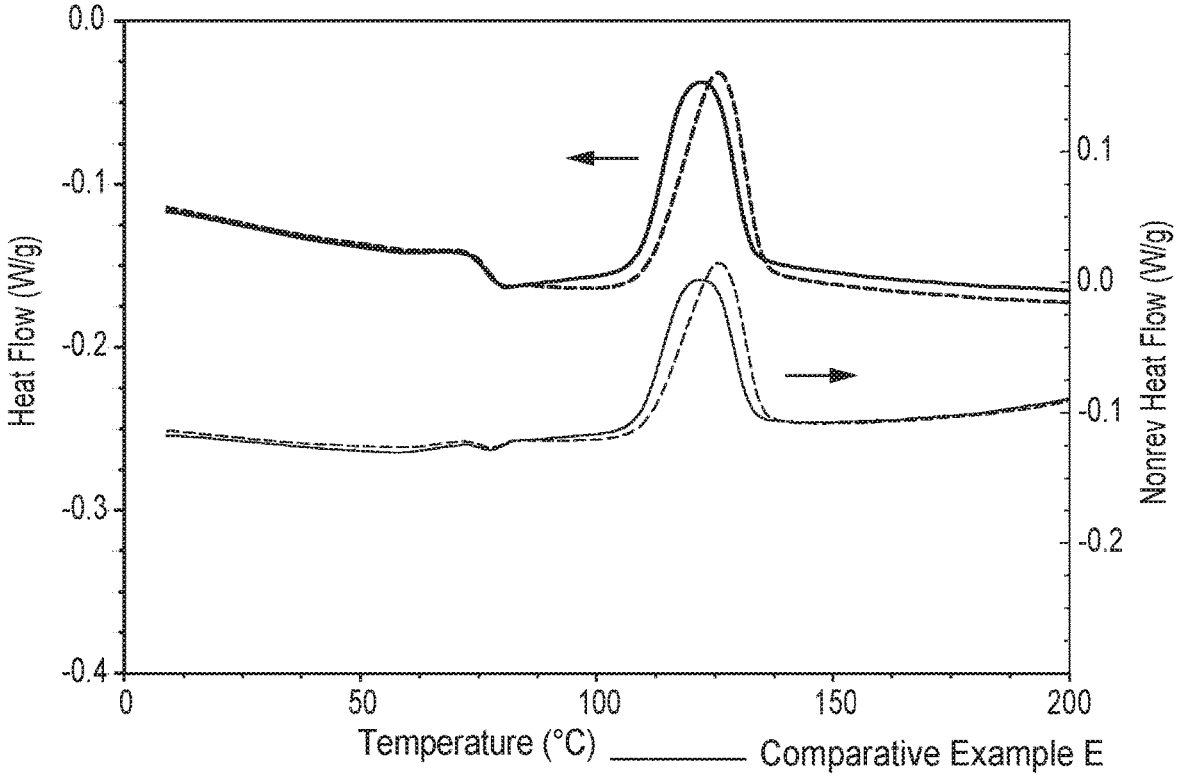
FIG. 3B is an expanded plot of the low temperature range of the total, and non-reversible heat flow curves of FIG. 3A

Additionally, in certain exemplary embodiments exemplified by FIGS. 3A-3B, the first-heat total, reversible, and non-reversible heat-flow plots obtained using MDSC for semi-crystalline polyethylene terephthalate (PET) fibers subjected to in-flight heat treatment according to the present disclosure (Example 9), when compared to identically-prepared melt blown fibers not subjected to in-flight heat treatment (Comparative Example E), shows a shift of the cold crystallization (crystallization on heating) peak to a higher cold crystallization temperature ($T_{cc}$) in the region between 100° C. and 140° C., that is, at a temperature above the $T_g$ (about 75° C.) and below the Nominal Melting Point (about 256° C.).

Figure 3C:
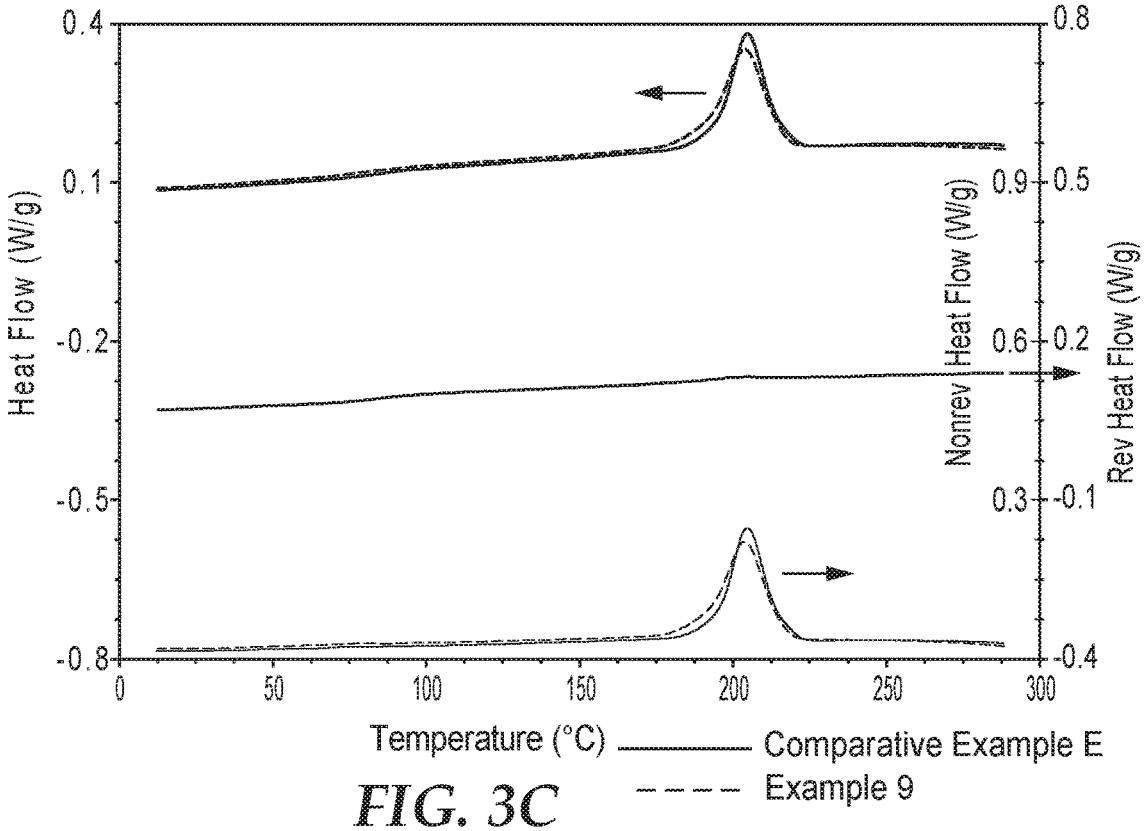
FIG. 3C is a plot of the total, reversible and non-reversible heat flow curves resulting from a first cooling after heating the nonwoven fibrous webs of Example 9 (with in-flight heat treatment) and Comparative Example E (without in-flight heat treatment) to a temperature above the Nominal Melting Point using MDSC.

Furthermore, in additional exemplary embodiments illustrated by FIG. 3C, a total heat flow curve obtained using MDSC on a first cooling after heating the nonwoven fibrous structure of Example 9 (having the in-flight heat treatment) to a temperature above the Nominal Melting Point, exhibits a shift of the Nominal Melting Point to a lower temperature and a shoulder on the crystallization peak between the glass transition temperature and the Nominal Melting Point, when compared to a total heat flow curve obtained using MDSC on a first cooling after heating the nonwoven fibrous structure of Comparative Example E (not having the in-flight heat treatment) above the Nominal Melting Point, reflecting a delay in the onset of crystallization on cooling.

Optional Nonwoven Fibrous Structure (Web) Components

In further exemplary embodiments, the nonwoven melt blown fibrous structures of the present disclosure may further comprise one or more optional components. The optional components may be used alone or in any combination suitable for the end-use application of the nonwoven melt blown fibrous structures. Three non-limiting, currently preferred optional components include optional electret fiber components, optional non-melt blown fiber components, and optional particulate components as described further below.

Optional Electret Fiber Component

The nonwoven melt blown fibrous webs of the present disclosure may optionally comprise electret fibers. Suitable electret fibers are described in U.S. Pat. Nos. 4,215,682; 5,641,555; 5,643,507; 5,658,640; 5,658,641; 6,420,024; 6,645,618, 6,849,329; and 7,691,168, the entire disclosures of which are incorporated herein by reference.

Suitable electret fibers may be produced by meltblowing fibers in an electric field, e.g. by melting a suitable dielectric material such as a polymer or wax that contains polar molecules, passing the molten material through a melt-blowing die to form discrete fibers, and then allowing the molten polymer to re-solidify while the discrete fibers are exposed to a powerful electrostatic field. Electret fibers may also be made by embedding excess charges into a highly insulating dielectric material such as a polymer or wax, e.g. by means of an electron beam, a corona discharge, injection from an electron, electric breakdown across a gap or a dielectric barrier, and the like. Particularly suitable electret fibers are hydrocharged fibers.

Optional Non-Melt Blown Fiber Component

In additional exemplary embodiments, the nonwoven fibrous structure optionally further comprises a plurality of non-melt blown fibers. Thus, in exemplary embodiments, the nonwoven fibrous web may additionally comprise discrete non-melt blown fibers. Optionally, the discrete non-melt blown fibers are staple fibers. Generally, the discrete non-melt blown fibers act as filling fibers, e.g. to reduce the cost or improve the properties of the melt blown nonwoven fibrous web.

Non-limiting examples of suitable non-melt blown filling fibers include single component synthetic fibers, semi-synthetic fibers, polymeric fibers, metal fibers, carbon fibers, ceramic fibers, and natural fibers. Synthetic and/or semi-synthetic polymeric fibers include those made of polyester (e.g., polyethylene terephthalate), nylon (e.g., hexamethylene adipamide, polycaprolactam), polypropylene, acrylic (formed from a polymer of acrylonitrile), rayon, cellulose acetate, polyvinylidene chloride-vinyl chloride copolymers, vinyl chloride-acrylonitrile copolymers, and the like.

Non-limiting examples of suitable metal fibers include fibers made from any metal or metal alloy, for example, iron, titanium, tungsten, platinum, copper, nickel, cobalt, and the like.

Non-limiting examples of suitable carbon fibers include graphite fibers, activated carbon fibers, poly(acrylonitrile)-derived carbon fibers, and the like.

Non-limiting examples of suitable ceramic fibers include any metal oxide, metal carbide, or metal nitride, including but not limited to silicon oxide, aluminum oxide, zirconium oxide, silicon carbide, tungsten carbide, silicon nitride, and the like.

Non-limiting examples of suitable natural fibers include those of bamboo, cotton, wool, jute, agave, sisal, coconut, soybean, hemp, and the like.

The fiber component used may be virgin fibers or recycled waste fibers, for example, recycled fibers reclaimed from garment cuttings, carpet manufacturing, fiber manufacturing, textile processing, or the like.

The size and amount of discrete non-melt blown filling fibers, if included, used to form the nonwoven fibrous web, will generally depend on the desired properties (i.e., loftiness, openness, softness, drapability) of the nonwoven fibrous web 100 and the desired loading of the chemically active particulate. Generally, the larger the fiber diameter, the larger the fiber length, and the presence of a crimp in the fibers will result in a more open and lofty nonwoven article. Generally, small and shorter fibers will result in a more compact nonwoven article.

Optional Particulate Component

In certain exemplary embodiments, the nonwoven fibrous structure further comprises a plurality of particulates. Exemplary nonwoven fibrous webs according to the present disclosure may advantageously include a plurality of chemically active particulates. The chemically active particulates can be any discrete particulate, which is a solid at room temperature, and which is capable of undergoing a chemical interaction with an external fluid phase. Exemplary chemical interactions include adsorption, absorption, chemical reaction, catalysis of a chemical reaction, dissolution, and the like.

Additionally, in any of the foregoing exemplary embodiments, the chemically active particulates may advantageously be selected from sorbent particulates (e.g. adsorbent particulates, absorbent particulates, and the like), dessicant particulates (e.g. particulates comprising a hygroscopic substance such as, for example, calcium chloride, calcium sulfate, and the like, that induces or sustains a state of dryness in its local vicinity), biocide particulates, microcapsules, and combinations thereof. In any of the foregoing embodiments, the chemically active particulates may be selected from activated carbon particulates, activated alumina particulates, silica gel particulates anion exchange resin particulates, cation exchange resin particulates, molecular sieve particulates, diatomaceous earth particulates, anti-microbial compound particulates, metal particulates, and combinations thereof.

In one exemplary embodiment of a nonwoven fibrous web particularly useful as a fluid filtration article, the chemically active particulates are sorbent particulates. A variety of sorbent particulates can be employed. Sorbent particulates include mineral particulates, synthetic particulates, natural sorbent particulates or a combination thereof. Desirably the sorbent particulates will be capable of absorbing or adsorbing gases, aerosols, or liquids expected to be present under the intended use conditions.

The sorbent particulates can be in any usable form including beads, flakes, granules or agglomerates. Preferred sorbent particulates include activated carbon; silica gel; activated alumina and other metal oxides; metal particulates (e.g., silver particulates) that can remove a component from a fluid by adsorption or chemical reaction; particulate catalytic agents such as hopcalite (which can catalyze the oxidation of carbon monoxide); clay and other minerals treated with acidic solutions such as acetic acid or alkaline solutions such as aqueous sodium hydroxide; ion exchange resins; molecular sieves and other zeolites; biocides; fungicides and virucides. Activated carbon and activated alumina are presently particularly preferred sorbent particulates. Mixtures of sorbent particulates can also be employed, e.g., to absorb mixtures of gases, although in practice to deal with mixtures of gases it may be better to fabricate a multilayer sheet article employing separate sorbent particulates in the individual layers.

In one exemplary embodiment of a nonwoven fibrous web particularly useful as a gas filtration article, the chemically active sorbent particulates are selected to be gas adsorbent or absorbent particulates. For example, gas adsorbent particulates may include activated carbon, charcoal, zeolites, molecular sieves, an acid gas adsorbent, an arsenic reduction material, an iodinated resin, and the like. For example, absorbent particulates may also include naturally porous particulate materials such as diatomaceous earth, clays, or synthetic particulate foams such as melamine, rubber, urethane, polyester, polyethylene, silicones, and cellulose. The absorbent particulates may also include superabsorbent particulates such as sodium polyacrylates, carboxymethyl cellulose, or granular polyvinyl alcohol.

In certain exemplary embodiments of a nonwoven fibrous web particularly useful as a liquid filtration article, the sorbent particulates comprise liquid an activated carbon, diatomaceous earth, an ion exchange resin (e.g. an anion exchange resin, a cation exchange resin, or combinations thereof), a molecular sieve, a metal ion exchange sorbent, an activated alumina, an antimicrobial compound, or combinations thereof. Certain exemplary embodiments provide that the web has a sorbent particulate density in the range of about 0.20 to about 0.5 g/cc.

Various sizes and amounts of sorbent chemically active particulates may be used to create a nonwoven fibrous web. In one exemplary embodiment, the sorbent particulates have a median size greater than 1 mm in diameter. In another exemplary embodiment, the sorbent particulates have a median size less than 1 cm in diameter. In further embodiments, a combination of particulate sizes can be used. In one exemplary additional embodiment, the sorbent particulates include a mixture of large particulates and small particulates.

The desired sorbent particulate size can vary a great deal and usually will be chosen based in part on the intended service conditions. As a general guide, sorbent particulates particularly useful for fluid filtration applications may vary in size from about 0.001 to about 3000 μm median diameter. Generally, the sorbent particulates are from about 0.01 to about 1500 μm median diameter, more generally from about 0.02 to about 750 μm median diameter, and most generally from about 0.05 to about 300 μm median diameter.

In certain exemplary embodiments, the sorbent particulates may comprise nanoparticulates having a population median diameter less than 1 μm. Porous nanoparticulates may have the advantage of providing high surface area for sorption of contaminants from a fluid medium (e.g., absorption and/or adsorption). In such exemplary embodiments using ultrafine or nanoparticulates, it may be preferred that the particulates are adhesively bonded to the fibers using an adhesive, for example a hot melt adhesive, and/or the application of heat to the melt blown nonwoven fibrous web (i.e., thermal bonding).

Mixtures (e.g., bimodal mixtures) of sorbent particulates having different size ranges can also be employed, although in practice it may be better to fabricate a multilayer sheet article employing larger sorbent particulates in an upstream layer and smaller sorbent particulates in a downstream layer. At least 80 weight percent sorbent particulates, more generally at least 84 weight percent and most generally at least 90 weight percent sorbent particulates are enmeshed in the web. Expressed in terms of the web basis weight, the sorbent particulate loading level may for example be at least about 500 gsm for relatively fine (e.g. sub-micrometer-sized) sorbent particulates, and at least about 2,000 gsm for relatively coarse (e.g., micro-sized) sorbent particulates.

In some exemplary embodiments, the chemically active particulates are metal particulates. The metal particulates may be used to create a polishing nonwoven fibrous web. The metal particulates may be in the form of short fiber or ribbon-like sections or may be in the form of grain-like particulates. The metal particulates can include any type of metal such as but not limited to silver (which has antibacterial/antimicrobial properties), copper (which has properties of an algaecide), or blends of one or more of chemically active metals.

In other exemplary embodiments, the chemically active particulates are solid biocides or antimicrobial agents. Examples of solid biocide and antimicrobial agents include halogen containing compounds such as sodium dichloroisocyanurate dihydrate, benzylkoniumchloride, halogenated dialkylhydantoins, and triclosan.

In further exemplary embodiments, the chemically active particulates are microcapsules. Microcapsules are described in U.S. Pat. No. 3,516,941 (Matson), and include examples of the microcapsules that can be used as the chemically active particulates. The microcapsules may be loaded with solid or liquid biocides or antimicrobial agents. One of the main qualities of a microcapsule is that by means of mechanical stress the particulates can be broken in order to release the material contained within them. Therefore, during use of the nonwoven fibrous web, the microcapsules will be broken due to the pressure exerted on the nonwoven fibrous web, which will release the material contained within the microcapsule.

In certain such exemplary embodiments, it may be advantageous to use at least one particulate that has a surface that can be made adhesive or "sticky" so as to bond together the particulates to form a mesh or support nonwoven fibrous web for the fiber component. In this regard, useful particulates may comprise a polymer, for example, a thermoplastic polymer, which may be in the form of discontinuous fibers. Suitable polymers include polyolefins, particularly thermoplastic elastomers (TPE's) (e.g., VISTAMAXX™, available from Exxon-Mobil Chemical Company, Houston, Tex.). In further exemplary embodiments, particulates comprising a TPE, particularly as a surface layer or surface coating, may be preferred, as TPE's are generally somewhat tacky, which may assist bonding together of the particulates to form a three-dimensional network before addition of the fibers to form the nonwoven fibrous web. In certain exemplary embodiments, particulates comprising a VISTAMAXX™ TPE may offer improved resistance to harsh chemical environments, particularly at low pH (e.g., pH no greater than about 3) and high pH (e.g., pH of at least about 9) and in organic solvents.

Any suitable size or shape of particulate material may be selected. Suitable particulates may have a variety of physical forms (e.g., solid particulates, porous particulates, hollow bubbles, agglomerates, discontinuous fibers, staple fibers, flakes, and the like); shapes (e.g., spherical, elliptical, polygonal, needle-like, and the like); shape uniformities (e.g., monodisperse, substantially uniform, non-uniform or irregular, and the like); composition (e.g. inorganic particulates, organic particulates, or combination thereof); and size (e.g., sub-micrometer-sized, micro-sized, and the like).

With particular reference to particulate size, in some exemplary embodiments, it may be desirable to control the size of a population of the particulates. In certain exemplary embodiments, particulates are physically entrained or trapped in the fiber nonwoven fibrous web. In such embodiments, the population of particulates is generally selected to have a median diameter of at least 50 μm, more generally at least 75 μm, still more generally at least 100 μm.

In other exemplary embodiments, it may be preferred to use finer particulates that are adhesively bonded to the fibers using an adhesive, for example a hot melt adhesive, and/or the application of heat to one or both of thermoplastic particulates or thermoplastic fibers (i.e., thermal bonding). In such embodiments, it is generally preferred that the particulates have a median diameter of at least 25 μm, more generally at least 30 μm, most generally at least 40 μm. In some exemplary embodiments, the chemically active particulates have a median size less than 1 cm in diameter. In other embodiments, the chemically active particulates have a median size of less than 1 mm, more generally less than 25 micrometers, even more generally less than 10 micrometers.

However, in other exemplary embodiments in which both an adhesive and thermal bonding are used to adhere the particulates to the fibers, the particulates may comprise a population of sub-micrometer-sized particulates having a population median diameter of less than one micrometer (μm), more generally less than about 0.9 μm, even more generally less than about 0.5 μm, most generally less than about 0.25 μm. Such sub-micrometer-sized particulates may be particularly useful in applications where high surface area and/or high absorbency and/or adsorbent capacity is desired. In further exemplary embodiments, the population of sub-micrometer-sized particulates has a population median diameter of at least 0.001 μm, more generally at least about 0.01 μm, most generally at least about 0.1 μm, most generally at least about 0.2 μm.

In further exemplary embodiments, the particulates comprise a population of micro-sized particulates having a population median diameter of at most about 2,000 μm, more generally at most about 1,000 μm, most generally at most about 500 μm. In other exemplary embodiments, the particulates comprise a population of micro-sized particulates having a population median diameter of at most about 10 μm, more generally at most about 5 μm, even more generally at most about 2 μm (e.g., ultrafine micro-fibers).

Multiple types of particulates may also be used within a single finished web. Using multiple types of particulates, it may be possible to generate continuous particulate webs even if one of the particulate types does not bond with other particulates of the same type. An example of this type of system would be one where two types are particulates are used, one that bonds the particulates together (e.g., a discontinuous polymeric fiber particulate) and another that acts as an active particulate for the desired purpose of the web (e.g., a sorbent particulate such as activated carbon). Such exemplary embodiments may be particularly useful for fluid filtration applications.

Depending, for example, on the density of the chemically active particulate, size of the chemically active particulate, and/or desired attributes of the final nonwoven fibrous web article, a variety of different loadings of the chemically active particulates may be used relative to the total weight of the fibrous web. In one embodiment, the chemically active particulates comprise less than 90% wt. of the total nonwoven article weight. In one embodiment, the chemically active particulates comprise at least 10% wt. of the total nonwoven article weight.

In any of the foregoing embodiments, the chemically active particulates may be advantageously distributed throughout the entire thickness of the nonwoven fibrous web. However, in some of the foregoing embodiments, the chemically active particulates are preferentially distributed substantially on a major surface of the nonwoven fibrous web.

Furthermore, it is to be understood that any combination of one or more of the above described chemically active particulates may be used to form nonwoven fibrous webs according to the present disclosure.

Articles

Nonwoven melt blown fibrous structures can be made using the foregoing melt-blowing apparatus and processes. In some exemplary embodiments, the nonwoven melt blown fibrous structure takes the form of a mat, web, sheet, a scrim, or a combination thereof.

In some particular exemplary embodiments, the melt-blown nonwoven fibrous structure or web may advantageously include charged melt blown fibers, e.g., electret fibers. In certain exemplary embodiments, the melt-blown nonwoven fibrous structure or web is porous. In some additional exemplary embodiments, the melt-blown nonwoven fibrous structure or web may advantageously be self-supporting. In further exemplary embodiments, the melt-blown nonwoven fibrous structure or web advantageously may be pleated, e.g., to form a filtration medium, such as a liquid (e.g., water) or gas (e.g., air) filter, a heating, ventilation or air conditioning (HVAC) filter, or a respirator for personal protection. For example, U.S. Pat. No. 6,740,137 discloses nonwoven webs used in a collapsible pleated filter element.

Webs of the present disclosure may be used by themselves, e.g., for filtration media, decorative fabric, or a protective or cover stock. Or they may be used in combination with other webs or structures, e.g., as a support for other fibrous layers deposited or laminated onto the web, as in a multilayer filtration media, or a substrate onto which a membrane may be cast. They may be processed after preparation as by passing them through smooth calendering rolls to form a smooth-surfaced web, or through shaping apparatus to form them into three-dimensional shapes.

A fibrous structure of the present disclosure can further comprise at least one or a plurality of other types of fibers (not shown) such as, for example, staple or otherwise discontinuous fibers, melt spun continuous fibers or a combination thereof. The present exemplary fibrous structures can be formed, for example, into a non-woven web that can be wound about a tube or other core to form a roll, and either stored for subsequent processing or transferred directly to a further processing step. The web may also be cut into individual sheets or mats directly after the web is manufactured or sometime thereafter.

The melt-blown nonwoven fibrous structure or web can be used to make any suitable article such as, for example, a thermal insulation article, an acoustic insulation article, a fluid filtration article, a wipe, a surgical drape, a wound dressing, a garment, a respirator, or a combination thereof. The thermal or acoustic insulation articles may be used as an insulation component for vehicles (e.g., trains, airplanes, automobiles and boats). Other articles such as, for example, bedding, shelters, tents, insulation, insulating articles, liquid and gas filters, wipes, garments, garment components, personal protective equipment, respirators, and the like, can also be made using melt blown nonwoven fibrous structures of the present disclosure.

Flexible, drape-able and compact nonwoven fibrous webs may be preferred for certain applications, for examples as furnace filters or gas filtration respirators. Such nonwoven fibrous webs typically have a density greater than 75 $kg/m^3$ and typically greater than 100 $kg/m^3$ or even 120 100 $kg/m^3$. However, open, lofty nonwoven fibrous webs suitable for use in certain fluid filtration applications generally have a maximum density of 60 $kg/m^3$. Certain nonwoven fibrous webs according to the present disclosure may have Solidity less than 20%, more generally less than 15%, even more preferable less than 10%.

Among other advantages, the melt blown fibers and melt blown nonwoven fibrous structures (e.g., webs) are dimensionally stable even when heated or used at elevated temperatures. Thus, in exemplary embodiments, the disclosure provides a non-woven fibrous structure prepared using any of the foregoing apparatuses and processes. In some particular exemplary embodiments, this non-woven fiber generation and in-flight heat treatment process provides fibers and nonwoven fibrous webs containing such fibers with a reduced tendency to shrink and degrade under higher temperature applications, such as, for example, providing acoustic insulation in an automobile, train, aircraft, boat, or other vehicle.

Additionally, exemplary nonwoven fibrous webs of the present disclosure may exhibit a Compressive Strength, as measured using the test method disclosed herein, greater than 1 kiloPa (kPa), greater than 1.2 kPa, greater than 1.3 kPa, greater than 1.4 kPa, or even greater than 1.5 kPa. Furthermore, exemplary nonwoven fibrous webs of the present disclosure may exhibit a Maximum Load Tensile Strength, as measured using the test method disclosed herein, of greater than 10 Newtons (N), greater than 50 N, greater than 100 N, greater than 200 N, or even greater than 300 N. Moreover, exemplary nonwoven fibrous webs of the present disclosure may exhibit an Apparent Crystallite Size, as measured using Wide Angle X-ray Scattering as disclosed herein, of 30-50 Å, inclusive.

Some of the various embodiments of the present disclosure are further illustrated in the following illustrative Examples. Several examples are identified as Comparative Examples, because they do not show certain properties (such as dimensional stability e.g., low Shrinkage, MDSC characteristics, increased Compression Strength, increased Tensile Strength, etc.); however, the Comparative Examples may be useful for other purposes, and establish novel and nonobvious characteristics of the Examples.

EXAMPLES

The following Examples are merely for illustrative purposes and are not meant to be overly limiting on the scope of the appended claims. Notwithstanding that the numerical ranges and parameters setting forth the broad scope of the present disclosure are approximations, the numerical values set forth in the specific examples are reported as precisely as possible. Any numerical value, however, inherently contains certain errors necessarily resulting from the standard deviation found in their respective testing measurements. At the very least, and not as an attempt to limit the application of the doctrine of equivalents to the scope of the claims, each numerical parameter should at least be construed in light of the number of reported significant digits and by applying ordinary rounding techniques.

Unless otherwise noted, all parts, percentages, ratios, and the like in the Examples and the rest of the specification are provided on the basis of weight. Solvents and other reagents used may be obtained from Sigma-Aldrich Chemical Company (Milwaukee, Wis.) unless otherwise noted.

Test Methods:

The following test methods are used to characterize the nonwoven melt blown fibrous webs of the Examples.

Median Fiber Diameter

The median Fiber Diameter of the melt blown fibers in the nonwoven fibrous webs of the Examples was measured using electron microscopy (EM).

Solidity

Solidity is determined by dividing the measured bulk density of the nonwoven fibrous web by the density of the materials making up the solid portion of the web. Bulk density of a web can be determined by first measuring the weight (e.g. of a 10-cm-by-10-cm section) of a web. Dividing the measured weight of the web by the web area provides the basis weight of the web, which is reported in $g/m^2$. The thickness of the web can be measured by obtaining (e.g., by die cutting) a 135 mm diameter disk of the web and measuring the web thickness with a 230 g weight of 100 mm diameter centered atop the web. The bulk density of the web is determined by dividing the basis weight of the web by the thickness of the web and is reported as $g/m^3$.

The solidity is then determined by dividing the bulk density of the nonwoven fibrous web by the density of the material (e.g. (co)polymer) comprising the solid fibers of the web. The density of a bulk (co)polymer can be measured by standard means if the supplier does not specify the material density. Solidity is a dimensionless fraction which is usually reported in percentage.

Loft

Loft is reported as 100% minus the solidity (e.g., a solidity of 7% equates to a loft of 93%).

Modulated Differential Scanning Calorimetry (MDSC)

Thermal characteristics of the nonwoven fibrous webs in certain of the Examples and Comparative Examples were measured using a TA Instruments Q2000 Modulated Differential Scanning calorimeter (MDSC). Specimens were weighed and loaded into TA Instruments $T_{zero}$ aluminum pans. A linear heating rate of 4° C./min. was applied with a perturbation amplitude of ±0.636° C. every 60 seconds. The specimens were subjected to a short hold to dry the specimen followed by a heat (H1)-quench cool (Q)-heat (H2)-slow cool (C2)-heat (H3) profile over a temperature range of 0 to 290° C. The first heating reversible and non-reversible heat flows were measured.

Shrinkage Measurements

The shrinkage properties of the melt-blown webs were calculated for each web sample using three 10 cm by 10 cm specimens in both the machine (MD) and cross direction (CD). The dimensions of each specimen was measured before and after their placement in a Fisher Scientific Isotemp Oven at 80° C. for 60 minutes, 150° C. for 60 minutes, and 150° C. for 7 days. Shrinkage for each specimen was calculated in the MD and CD by the following equation:

$$\text{Shrinkage} = \left(\frac{L_0 - L}{L_0}\right) \times 100\%$$

where $L_0$ is the initial specimen length and L is the final specimen length. Average values of shrinkage were calculated and reported in the Tables below.

Compressive Strength

The Compressive Strength of the webs was measured according to the following procedure. Circular test samples of 120 mm diameter were cut from the webs. The samples were tested using a conventional INSTRON tensile testing machine using 150 mm diameter compression plates and a crosshead speed of 25 mm/min. The anvil start height was set slightly higher than the sample thickness. The test cycle sequence was as follows. The thickness of the sample was measured at 0.002 psi (13.79 Pa). Compression continued until the sample was at 50% compression based on the initial thickness.

The Compressive Strength at 50% compression was recorded in pounds per square inch and converted to kilopascals (kPa). The compression plates were then returned to the initial anvil starting height. Compression was then paused for 30 seconds and this cycle was then repeated 9 times for a total of 10 cycles for each sample.

Three replicates of each sample web were tested. The three replicates were averaged and the Compressive Strength (kPa) was calculated using the average of all 10 cycles.

Maximum Load Tensile Strength

The tensile strength at maximum load of the webs was measured according to ASTM D 5034-2008 using a crosshead speed of 300 mm/min and a 150 mm grab distance. The maximum load in Newtons (N) was recorded for each test sample. Five replicates of each sample web were tested and the results were averaged to obtain the Maximum Load Tensile Strength.

Apparent Crystallite Size ($D_{app}$)

Wide Angle X-Ray Scattering (WAXS)

Samples were placed on the surface of zero background silicon specimen holders prior to data collection. Reflection geometry wide angle X-ray (WAXS) data were collected in the form of a survey scan by use of a PANalytical (Westborough, Mass.) Empyrean vertical diffractometer, copper $K_\alpha$, radiation, and scintillation detector registry of the scattered radiation. The diffractometer employs variable incident beam slits and fixed diffracted beam slits. Survey scans were conducted from 10 to 55 degrees (2θ) using a 0.04 degree step size and 6 second dwell time. X-ray generator settings of 40 kV and 40 mA were employed.

Small Angle X-Ray Scattering (SAXS)

The incident X-ray beam was positioned normal to the sample plane during data collection. Transmission small angle X-ray scattering (SAXS) data were collected by use of a slit collimated Kratky compact camera (Anton-Paar, Graz, Austria), copper $K_\alpha$, radiation, and linear position sensitive detector registry of the scattered radiation. Data were accumulated for 10800 seconds at a 24 cm sample to detector distance. An incident slit height of 30 μm was used with X-ray generator settings of 40 kV and 30 mA.

Analysis and plotting of WAXS and SAXS data was accomplished through use of X-ray diffraction analysis software JADE (v9, MDI, Livermore Calif.). Observed diffraction peaks were subjected to profile fitting using a Pearson VII peak shape model, cubic spline background model, and application of X-ray diffraction analysis software JADE (v9. MDI, Livermore Calif.). Peak widths were taken as the full width at half maximum (FWHM) of the $K_{\alpha 1}$ component. Apparent Crystallite Size ($D_{app}$) was determined from observed peak Full Width at Half Maximum (FWHM) values after corrections for instrumental broadening and employing a shape factor of 0.9, using the Scherrer equation (see P. Scherrer, *Göttinger Nachrichten,* 2, p. 98 (1918):

$$D_{app}=K\lambda/\beta\cos(\theta)\text{ (result in Å)}$$

where: K=0.90 (shape factor)

λ=1.540598 Å (wavelength Cu $K_{\alpha 1}$ x-ray source)

β=peak FWHM (radians) after correction for instrumental broadening

θ=one half of the peak position 2θ

Additional information on this method of determining $D_{app}$ may be found, for example, in *X-ray Diffraction Procedures for Polycrystalline and Amorphous Materials*, Harold P. Klug and Leroy E. Alexander (John Wiley & Sons, Inc., New York, (1954))), Chapter 9, p. 491).

Example 1

The nonwoven melt blown webs of the present disclosure were prepared by a process similar to that described in Wente, Van A., "Superfine Thermoplastic Fibers" in Industrial Engineering Chemistry, Vol. 48, pages 1342 et seq. (1956), and in Report No. 4364 of the Naval Research Laboratories, published May 25, 1954 entitled "Manufacture of Superfine Organic Fibers" by Wente, Van. A. Boone, C. D., and Fluharty, E. L., except that a drilled die was used to produce the fibers. Polyethylene terephthalate (PET) thermoplastic (co)polymer was extruded through the die into a high velocity stream of heated air which draws out and attenuates the fibers prior to their solidification and collection. The fibers were collected in a random fashion on a nylon belt.

The molten fibers were blown out of the die onto the collector. Immediately after exiting the die and before reaching the collector, the fibers passed between two infra red (IR) heaters having a quartz IR lamp array, with one heater above the fiber stream and one heater below the fiber stream. The gap between the heaters was approximately 15.25 cm (6 inches).

The IR heaters were manufactured by Research, Inc. of Eden Prairie, Minn. Each heater had a 40.6 cm (16 inch) width in the cross web direction and a 33 cm (13 inch) length in the down web direction. The heater had a maximum intensity of 14 watts/square cm (90 watts/square inch). All samples were made with 0% or 100% heater intensity.

PET nonwoven melt blown microfibrous webs were produced with a target basis weight of 210 grams/meter. The PET melt blown microfibrous webs were prepared from a 0.55 intrinsic viscosity PET resin (8396 PET) obtained from Invista (Wichita, Kans.). The Fiber Diameter (EFD) of the melt blown webs ranged from 7.0-8.5 micrometers. The first cool MDSC test data after first heating the fiber sample above the Nominal Melting Point are plotted in FIG. 2. Shrinkage determined according to the Shrinkage Test is reported in Table 1.

Comparative Example A

A melt-blown nonwoven fibrous web was prepared identically to the web of Example 1, except that no in-flight heat treatment was used. The first cool MDSC test data after first heating the fiber sample above the Nominal Melting Point are plotted in FIG. 2. Shrinkage determined according to the Shrinkage Test is reported in Table 1.

TABLE 1

| | Shrinkage (%) | |
|---|---|---|
| Sample | 0% IR Heating | 100% IR Heating |
| Comparative Example A | 37.0 | — |
| Example 1 | — | 2.3 |

Examples 2-3

Examples 2-3 were prepared as in Example 1 except staple fibers were added into the web using the procedures described in U.S. Pat. No. 4,118,531 (Hauser et al.). The staple fibers were oriented poly(ethylene terephthalate) (pentalobal, 6 denier, 3.2 cm length) crimped staple fibers designated as IndoRama T295 obtained from Auriga Polymers Inc, Mills River, N.C. The composition of the resulting web was 70% by weight of the 8396 PET fibers of Example 1 and 30% by weight of T295 staple fibers, with a total web basis weight of 300 gsm. The resulting webs were irradiated with infra red lamps as in Example 1 at 0%, 50% and 100% power. Samples of the webs were tested for shrinkage properties as in Example 1 and are reported below in Table 2.

Comparative Example B

A melt-blown nonwoven fibrous web was prepared identically to the web of Example 2-3, except that no in-flight IR heating was used. Shrinkage determined according to the Shrinkage Test is reported in Table 2.

TABLE 2

| Sample | Shrinkage (%) 0% IR Heating | 50% IR Heating | 100% IR Heating |
|---|---|---|---|
| Comparative Example B | 10.3 | — | — |
| Example 2 | — | 5.8 | — |
| Example 3 | — | — | 2.8 |

Example 4

Example 4 was prepared as in Example 1 except a flame retardant-zinc diethylphosphinate obtained from Clariant Corp. and designated as EXOLIT™ OP950 (Nominal Melting Point of 220° C., degradation temperature of 380° C., phosphorous content of approximately 20%) was added at 10% by weight of the web. The resulting webs were irradiated with infra red lamps as in Example 1 at 0%, 50% and 100% power. Samples of the webs were tested for shrinkage properties as in Example 1 and are reported below in Table 3.

Comparative Example C

A melt-blown nonwoven fibrous web was prepared identically to the web of Example 4, except that no in-flight IR heating was used. Shrinkage determined according to the Shrinkage Test is reported in Table 3.

TABLE 3

| Sample | Shrinkage (%) 0% IR Heating | 100% IR Heating |
|---|---|---|
| Comparative Example C | 21.2 | — |
| Example 4 | — | 2.5 |

Examples 5-7

Examples 5-7 were prepared as in Example 1 except a blend of polylactic acid (PLA) and polypropylene (PP) was used to extrude the fibers. The polylactic acid (PLA) resin grade was obtained from Natureworks, LLC, Minnetonka, Minn. available as Natureworks 6202D. The resin was dried at 135° F. in a conventional forced air over overnight before use. Two grades of polypropylene were used; one supplied from Total Petrochemical (PP1105E1) and one from ExxonMobil Chemical (PP3860X). The polypropylene was blended with the PLA at a 3% by weight loading. The basis weight of the melt blown webs was approximately 75 gsm. The Fiber Diameter (EFD) of the melt blown webs ranged from 7-9 micrometers. Shrinkage testing of the PLA/PP webs was done by heating a 10 cm square sample at 70° C. for 72 hours in a conventional lab oven. The resulting webs were irradiated with infra red lamps as in Example 1 at 0% and 50% power. Shrinkage determined according to the Shrinkage Test is reported in Table 4 below.

TABLE 4

| Sample | Shrinkage (%) 0% IR Heating | 50% IR Heating |
|---|---|---|
| Example 5 (100% PLA) | 40 | 23 |
| Example 6 (97%/3% PLA/PP) | 18 | 0.8 |
| Example 7 (97%/3% PLA/PP) | 26 | 0.8 |

Example 8

Example 8 was prepared as in Example 2 except aluminum plates were put above and below the die to create a hot enclosure by entraining the hot air generated during the melt blown process. The aluminum plates were 58.4 cm (23 inches long measured along the die length), 33 cm (13 inches wide from die to collector), and 2.3 mm (0.090 inches) thick. The PET resin used to produce the fibers was obtained from NanYa Plastics Corporation, Lake City, S.C. designated as NanYa N211. The basis weight of the webs was approximately 300 gsm. The Fiber Diameter (EFD) of the base melt blown webs ranged from 7-9 micrometers. Samples of the webs were tested for Shrinkage according to the Shrinkage Test; the results are reported in Table 5 below.

Comparative Example D

A melt-blown nonwoven fibrous web was prepared identically to the web of Example 8, except that no in-flight heat treatment was used. Shrinkage determined according to the Shrinkage Test is reported in Table 5.

TABLE 5

| Sample | Shrinkage (%) Shrinkage (%) |
|---|---|
| Comparative Example D (No Plates) | 7.2 |
| Example 8 (With Plates) | 4.2 |

Examples 9-10

Examples 9-10 were prepared as in Example 1 except convective (i.e., forced) hot air was used for in-flight heat treatment (as shown in FIG. 1B except that only the top hot air blower was used).

The PET resin used to produce the fibers was obtained from NanYa Plastics Corporation, Lake City, S.C. designated as NanYa N211. The Fiber Diameter (EFD) of the base melt blown webs ranged from 7-10 micrometers. The first heat MDSC test data for the fiber sample of Example 9 are plotted in FIGS. 3A-3B; the first cool MDSC test data after heating the fiber sample above the Nominal Melting Point are plotted in FIG. 3C. The WAXS test data for the fiber sample of Example 9 are plotted in FIG. 4. The SAXS test data for the fiber sample of Example 9 are plotted in FIG. 5. Samples of the webs were also tested for Shrinkage (%), Maximum Load Tensile Strength (N) according to the Tensile Strength test described above; the results are reported in Table 6 below.

Comparative Examples E and F

Melt-blown nonwoven fibrous webs were prepared identically to the webs of Examples 8 and 9 respectively, except that no in-flight heat treatment was used. The first heat MDSC test data for the fiber sample of Comparative Example E are plotted in FIGS. 3A-3B; the first cool MDSC test data after heating the fiber sample above the Nominal Melting Point are plotted in FIG. 3C. The WAXS test data for the fiber sample of Comparative Example E are plotted in FIG. 4. The SAXS test data for the fiber sample of Comparative Example E are plotted in FIG. 5. Samples of the webs were also tested for Shrinkage (%), Maximum Load Tensile Strength (N) according to the Tensile Strength test described above; the results are reported in Table 6 below.

Example 11

Example 11 was prepared as in Example 2 except convective (forced) hot air was used for in-flight heat treatment (as shown in FIG. 1B except that only top air blower was used).

The PET resin used to produce the fibers was obtained from NanYa Plastics Corporation, Lake City, S.C. designated as NanYa N211. The Fiber Diameter (EFD) of the base melt blown webs ranged from 7-10 micrometers. Samples of the webs were tested for Maximum Load Tensile Strength (N) and Compression Strength (kPa) according to the respective test methods described above; the results are reported in Table 6 below.

Comparative Example G

A melt-blown nonwoven fibrous web was prepared identically to the web of Example 11, except that no in-flight heat treatment was used. Samples of the webs were tested for Maximum Load Tensile Strength (N) and Compression Strength (kPa) according to the respective test methods described above; the results are reported in Table 6 below.

TABLE 6

| Sample | Basis Weight (gsm) | Shrinkage (%) | Maximum Load Tensile Strength (N) | Compression Strength (kPa) |
|---|---|---|---|---|
| Comparative Example E | 300 | 45.7 | 5.82 | — |
| Example 9 | 300 | 5.6 | 136 | — |
| Comparative Example F | 500 | — | 49 | — |
| Example 10 | 500 | — | 325.7 | — |
| Comparative Example G | 300 | — | 0.99 | 0.28 |
| Example 11 | 300 | — | 13.9 | 1.31 |

Discussion of MDSC Data for Example 9 and Comparative Example E

FIGS. 3A-3B show the first heat plots obtained using the MDSC test method described above, for Example 9 and Comparative Example E. FIG. 3C shows the first cool heat plots obtained using the MDSC test method for Example 9 and Comparative Example E, obtained after heating the samples above the Nominal Melting Point.

While the glass transition features are very similar for both materials, Example 9, compared to Comparative Example E, shows exothermic crystallization at a higher onset temperature (111° C. compared to 108° C.), and also shows a higher peak maximum cold crystallization temperature (126° C. versus 122° C.).

Both the in-flight heat treated and untreated webs prepared were estimated to have a very low level of crystalline content as prepared. When the sample crystalline content is estimated by calculating the net melting peak area and normalizing utilizing a theoretical heat of fusion of 140 J/g for PET, the material of Example 9 shows a slight increase in crystallinity (7%) relative to the untreated material (4%). However, the most significant difference noted with the web treated by the in-flight heat treating process (Example 9) relative to the untreated web (Comparative Example E), is the enhanced dimensional stability of the in-flight heat treated web when heated above the $T_g$ and more particularly above the $T_{cc}$, for example, to 150° C. or even higher temperatures.

While not wishing to be bound by any particular theory, these observations suggest that the reduction in the rate and delay in the onset temperature of cold crystallization of the semi-crystalline (co)polymer (e.g., PET) material above the $T_g$ is related to the slight difference in crystalline content obtained with in-flight heat treatment. However an additional change is noted in the PET. What is seen in materials that show reduced shrinkage is that the same materials continue to crystallize more slowly, even after melting. This suggests a change in nucleation behavior, for example, the production of fewer and/or larger nucleii or "seeds" for the fibers subjected to in-flight heat treatment. This effect is perhaps best exemplified by the first cooling cycle data of FIG. 3C, which show a shift to lower (re)crystallization temperatures for the in-flight heat treated fibers, but is also supported by measurement of the Apparent Crystallite Size using x-ray scattering (WAXS, SAXS), as described further below.

Discussion of WAXS and SAXS Data for Example 9 and Comparative Example E

Figure 4:
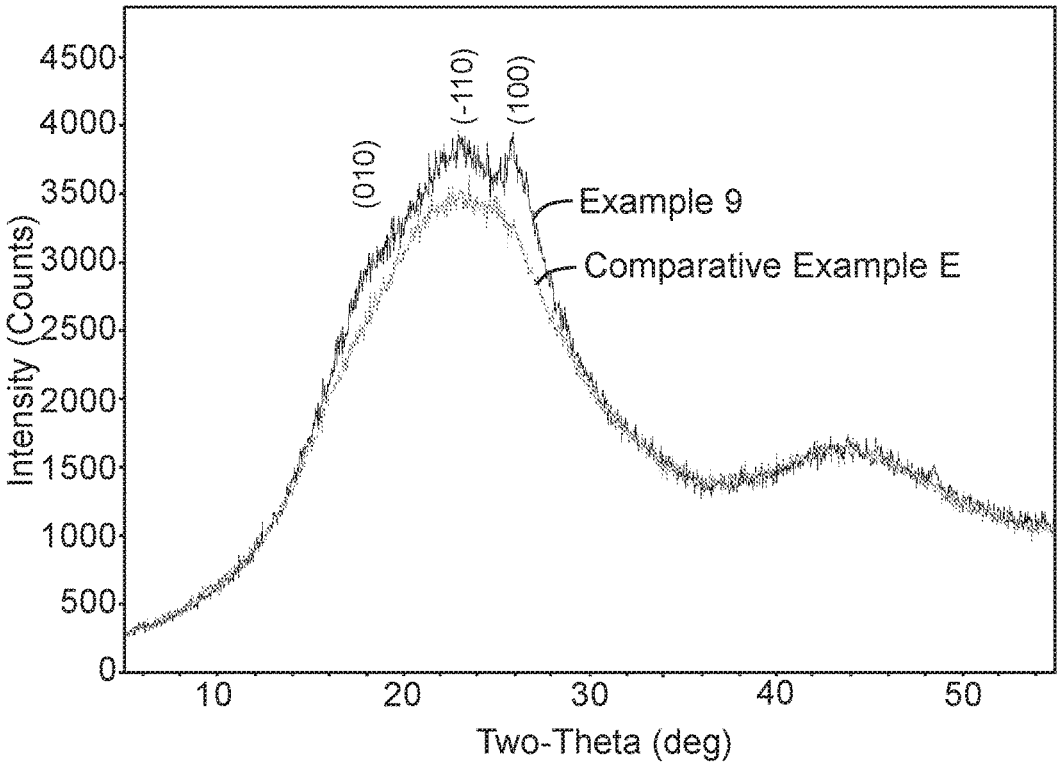
FIG. 4 is a plot of the Wide Angle X-ray Scattering (WAXS) data for the collected nonwoven fibrous webs of Example 9 (with in-flight heat treatment) and Comparative Example E (without in-flight heat treatment) according to exemplary embodiments of the present disclosure.
Figure 5:
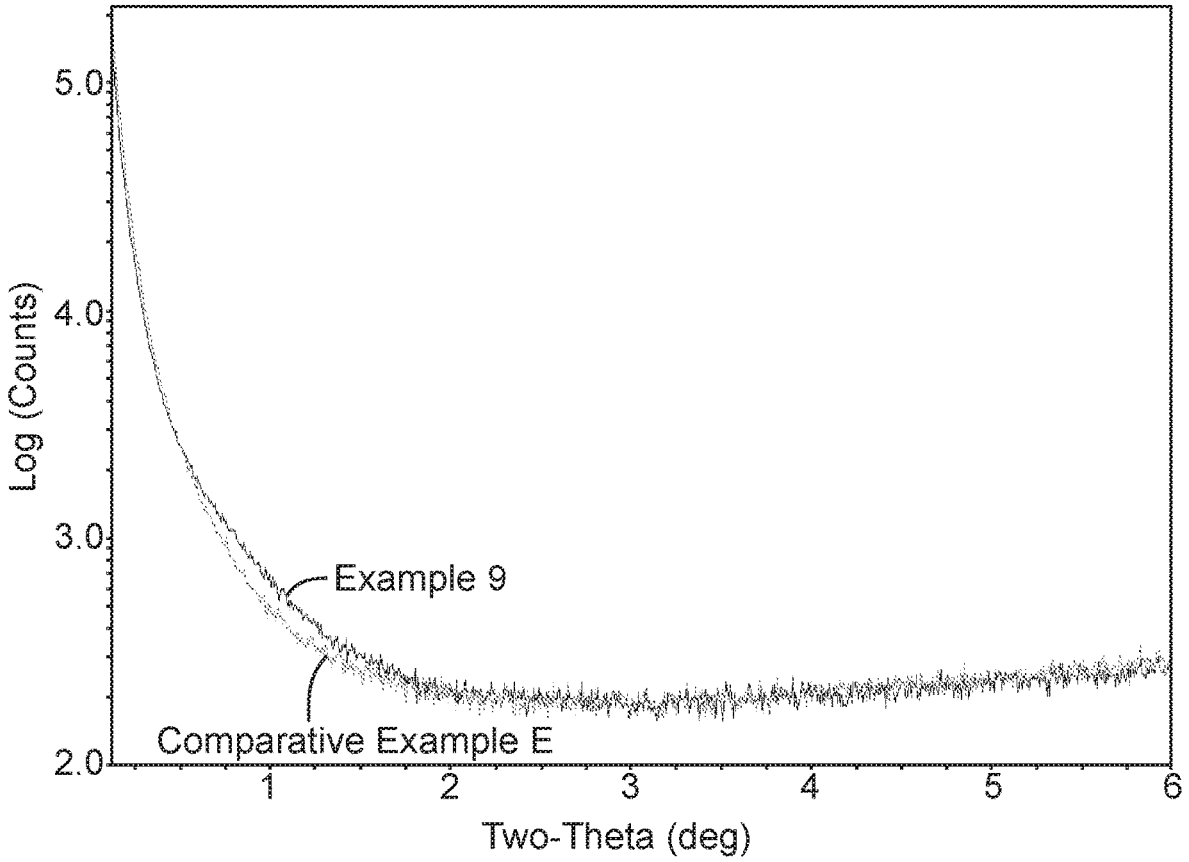
FIG. 5 is a plot of the Small Angle X-ray Scattering (SAXS) data for the collected nonwoven fibrous webs of Example 9 (with in-flight heat treatment) and Comparative Example E (without in-flight heat treatment) according to exemplary embodiments of the present disclosure.

The WAXS data for Example 9 and Comparative Example E are provided in FIG. 4. Comparative Example E, shows two broad diffuse maxima at approximately 21 and 42 degrees (2θ). The diffuse maxima are consistent with a low level of crystallinity and absence of large PET crystallites. The PET crystallites in this sample are sufficiently small and few in number that they do not produce resolved diffraction maxima.

In contrast, the WAXS data for Example 9 shows evidence of the PET triclinic (010), (−110), and (100) diffraction maxima superimposed upon the diffuse maxima observed for the sample (DS 063014-4). The increased scattering observed for Example 9 is consistent with the presence of a small number of larger crystallites in this sample produced by in-flight heat treatment. The Apparent Crystallite Size calculated for the newly formed crystallites in Example 9, based on the (010), (−110), and (100) maxima, are 34, 34, and 50 Å, respectively.

Reference throughout this specification to "one embodiment," "certain embodiments," "one or more embodiments" or "an embodiment," whether or not including the term "exemplary" preceding the term "embodiment," means that a particular feature, structure, material, or characteristic described in connection with the embodiment is included in at least one embodiment of the presently described present disclosure. Thus, the appearances of the phrases such as "in one or more embodiments," "in certain embodiments," "in one embodiment" or "in an embodiment" in various places throughout this specification are not necessarily referring to the same embodiment of the presently described present disclosure. Furthermore, the particular features, structures, materials, or characteristics may be combined in any suitable manner in one or more embodiments.

While the specification has described in detail certain exemplary embodiments, it will be appreciated that those skilled in the art, upon attaining an understanding of the foregoing, may readily conceive of alterations to, variations of, and equivalents to these embodiments. Accordingly, it should be understood that this disclosure is not to be unduly limited to the illustrative embodiments set forth hereinabove. Furthermore, all publications, published patent applications and issued patents referenced herein are incorporated by reference in their entirety to the same extent as if each individual publication or patent was specifically and individually indicated to be incorporated by reference. Various exemplary embodiments have been described. These and other embodiments are within the scope of the following claims.

What is claimed is:

1. A nonwoven fibrous structure comprising:

a plurality of melt blown fibers comprising molecules of at least one thermoplastic semi-crystalline (co)polymer, wherein the plurality of melt blown fibers have been subjected to a controlled in-flight heat treatment operation by applying forced hot air to the melt blown fibers immediately upon exit of the melt blown fibers from a plurality of orifices of a melt-blowing die, further wherein the controlled in-flight heat treatment operation takes place at a temperature below a melting temperature of the plurality of the melt blown fibers for a time sufficient to achieve stress relaxation of at least a portion of the molecules of the at least one thermoplastic semi-crystalline (co)polymer within the plurality of the meltblown fibers subjected to the controlled in-flight heat treatment operation, additionally wherein the plurality of melt-blown fibers do not contain a nucleating agent in an amount effective to achieve nucleation, and wherein a total heat flow curve obtained using MDSC on a first heating of the nonwoven fibrous structure shows a shift to a higher crystallization temperature when compared to a total heat flow curve obtained using MDSC on a first heating for an identically-prepared nonwoven fibrous structure without the controlled in-flight heat treatment operation, and further wherein the nonwoven fibrous structure exhibits a Solidity of from about 0.5% to about 12%, is dimensionally stable and exhibits a Shrinkage less than 15%.

2. A nonwoven fibrous structure of claim 1, wherein the at least one semi crystalline (co)polymer comprises an aliphatic polyester (co)polymer, an aromatic polyester (co) polymer, or a combination thereof.

3. A nonwoven fibrous structure of claim 1, wherein the semi-crystalline (co)polymer comprises poly(ethylene) terephthalate, poly(butylene) terephthalate, poly(ethylene) naphthalate, poly(lactic acid), poly(hydroxyl) butyrate, poly (trimethylene) terephthalate, or a combination thereof.

4. A nonwoven fibrous structure of claim 1, wherein the at least one thermoplastic semi-crystalline (co)polymer comprises a blend of a polyester (co)polymer and at least one other (co)polymer to form a polymer blend.

5. A nonwoven fibrous structure of claim 1, wherein the nonwoven fibrous structure is selected from the group consisting of mats, webs, sheets, scrims, fabrics, or a combination thereof.

6. A nonwoven fibrous structure of claim 1, wherein the melt blown fibers in the non-woven fibrous structure exhibit a median Fiber Diameter less than about 10 micrometers.

7. A nonwoven fibrous structure of claim 1, exhibiting a basis weight of from 100 gsm to about 350 gsm.

8. A nonwoven fibrous structure of claim 1, wherein a total heat flow curve obtained using MDSC on a first cooling after heating the nonwoven fibrous structure having the controlled in-flight heat treatment operation to the temperature above the Nominal Melting Point, exhibits a shoulder on a cold crystallization peak positioned between a glass transition temperature and the Nominal Melting Point, when compared to a total heat flow curve obtained using MDSC on a first cooling after heating above the Nominal Melting Point for the identically-prepared nonwoven fibrous structure without the controlled in-flight heat treatment operation.

9. A nonwoven fibrous structure of claim 1, wherein the Compressive Strength, as measured using the test method disclosed herein, is greater than 1 kPa.

10. A nonwoven fibrous structure of claim 1, wherein the Maximum Load Tensile Strength, as measured using the test method disclosed herein, is greater than 10 Newtons.

11. A nonwoven fibrous structure of claim 1, wherein the Apparent Crystallite Size, as measured using Wide Angle X-ray Scattering as disclosed herein, is from 30 Å to 50 Å, inclusive.

12. A nonwoven fibrous structure of claim 1, further comprising a plurality of particulates.

13. A nonwoven fibrous structure of claim 1, further comprising a plurality of non-melt blown fibers, optionally wherein the non-melt blown fibers are staple fibers.

* * * * *